US010890047B2

(12) United States Patent
Themig

(10) Patent No.: US 10,890,047 B2
(45) Date of Patent: Jan. 12, 2021

(54) WELLBORE STAGE TOOL WITH REDUNDANT CLOSING SLEEVES

(71) Applicant: Packers Plus Energy Services Inc., Calgary (CA)

(72) Inventor: Daniel Jon Themig, Calgary (CA)

( * ) Notice: Subject to any disclaimer, the term of this patent is extended or adjusted under 35 U.S.C. 154(b) by 23 days.

(21) Appl. No.: 15/606,854

(22) Filed: May 26, 2017

(65) Prior Publication Data

US 2017/0342800 A1 Nov. 30, 2017

Related U.S. Application Data

(60) Provisional application No. 62/342,634, filed on May 27, 2016.

(51) Int. Cl.

| | |
|---|---|
| ***E21B 33/14*** | (2006.01) |
| ***E21B 33/16*** | (2006.01) |
| ***E21B 34/06*** | (2006.01) |
| ***E21B 34/14*** | (2006.01) |
| ***E21B 33/12*** | (2006.01) |
| *E21B 33/128* | (2006.01) |
| *E21B 33/1295* | (2006.01) |

(52) U.S. Cl.

CPC ..... *E21B 33/146* (2013.01); *E21B 33/16* (2013.01); *E21B 34/063* (2013.01); *E21B 34/14* (2013.01); *E21B 33/128* (2013.01); *E21B 33/1285* (2013.01); *E21B 33/1295* (2013.01); *E21B 33/14* (2013.01); *E21B 2200/06* (2020.05)

(58) Field of Classification Search

CPC ... E21B 33/146; E21B 2034/007; E21B 34/14
See application file for complete search history.

(56) References Cited

U.S. PATENT DOCUMENTS

| | | | | |
|---|---|---|---|---|
| 2,968,636 | A | 1/1961 | Sciallano | |
| 5,279,370 | A * | 1/1994 | Brandell | E21B 33/128 166/184 |
| 5,314,015 | A * | 5/1994 | Streich | E21B 33/127 166/154 |
| 6,907,936 | B2 | 6/2005 | Fehr et al. | |
| 7,108,067 | B2 | 9/2006 | Themig et al. | |
| 9,121,255 | B2 | 9/2015 | Themig et al. | |

(Continued)

FOREIGN PATENT DOCUMENTS

| | | |
|---|---|---|
| WO | 2009/132462 | 11/2009 |

*Primary Examiner* — Robert E Fuller
*Assistant Examiner* — Theodore N Yao
(74) *Attorney, Agent, or Firm* — Prince Lobel Tye LLP

(57) ABSTRACT

A stage tool comprises a body with a tubular wall, defining an outer surface and an inner surface. Fluid ports, such as cement circulation ports, extend through the tubular wall. The stage tool further comprises a primary closing sleeve. The primary closing sleeve may be movable along the outer surface of the tubular wall for closing the ports when the treatment of the wellbore stage ends. A secondary closing sleeve may be movable along the inner surface of the tubular wall for closing the port in case of failure of the primary closing sleeve or for redundancy. The primary closing sleeve may be actuated by an internal member joined to the primary closing sleeve by a crosslink and movable on the inner surface. The internal member and the secondary closing sleeve may move along different surfaces on the internal wall to avoid interference.

21 Claims, 15 Drawing Sheets

(56) References Cited

U.S. PATENT DOCUMENTS

| | | | | |
|---|---|---|---|---|
| 2010/0206572 | A1* | 8/2010 | Makowiecki | E21B 33/146<br>166/332.1 |
| 2012/0247767 | A1* | 10/2012 | Themig | E21B 21/103<br>166/289 |
| 2018/0119519 | A1* | 5/2018 | Hazel | E21B 34/066 |
| 2018/0179857 | A1* | 6/2018 | Themig | E21B 33/146 |

* cited by examiner

WELLBORE STAGE TOOL WITH REDUNDANT CLOSING SLEEVES

RELATED APPLICATIONS

This patent application claims priority to U.S. Provisional Application Ser. No. 62/342,634, entitled "Wellbore Stage Tool with Redundant Closing Sleeves," filed 27 May 2016, which is hereby incorporated by reference herein for all purposes.

TECHNICAL FIELD

This specification relates to a tool for wellbore operations and in particular to a stage tool with redundant closing sleeves.

BACKGROUND

In wellbore operations, cementing may be used to control migration of fluids outside a liner installed in the wellbore. For example, cement may be installed in the annulus between the liner and the formation wall to deter migration of the fluids axially along the annulus.

Often cement is introduced by flowing cement down through the wellbore liner to its distal end and forcing it around the bottom and up into the annulus where it is allowed to set. Occasionally it is desirable to introduce cement into the annulus without pumping it around the bottom end of the liner. A stage tool may be used for this purpose, which allows cement to be introduced to the annulus through ports along the length of the liner.

Cementing stage tools generally include mechanisms to open flow passages that allow cement to flow through ports on the surface of the liner, into the wellbore, and then securely close the ports and therefore the flow passages. Some stage tools rely on a primary sleeve that shifts over the ports of the liner as a closing mechanism. Typically, with these tools, a wiper plug is pumped into the stage tool to land on the internal sleeve. As pressure is increased behind the wiper plug, the plug shifts the primary sleeve down over the inside of the ports, thereby closing them.

Some stage tools also include a secondary sleeve that may be used if the primary sleeve fails to fully close the ports. FIG. 11 is a diagrammatic representation of a conventional stage tool shown in a wellbore 1000 with a tubing string installed therein, having a primary closing sleeve 1002 and a secondary closing sleeve 1004 to close ports 1008. If primary closing sleeve 1002 fails to close, secondary closing sleeve 1004 is shifted up to seal back into the primary closing sleeve 1002, e.g., at interface 1003.

With a conventional stage tool as shown in FIG. 11, sealing of the ports 1008 when the primary closing sleeve 1002 fails to close, is dependent on the secondary closing sleeve 1004 properly sealing back into the primary closing sleeve 1002 and the outer seals 1010, 1012 on both the primary closing sleeve 1002 and secondary closing sleeve 1004 working properly. If seals 1010 of the primary closing sleeve 1002 are damaged in the initial attempt to shift the primary closing sleeve down, the secondary closing sleeve 1004 cannot seal the ports 1008 on its own. Thus, secondary closing sleeve 1004 does not provide true redundancy.

Moreover, in the conventional stage tool shown in FIG. 11 the primary and secondary closing sleeves 1002, 1004 share a sealing surface 1020 and have overlapping ranges of motion across that surface. If the primary closing sleeve 1002 shifts down but does not close the ports 1008, the primary closing sleeve may interfere with shifting the secondary closing sleeve 1004 up.

Typically, the secondary closing sleeve 1004 is shifted using a shifting tool. Prior to running in the shifting tool, however, the plug seat of the primary closing sleeve 1002 must be drilled out if the primary seat fails to seal and close off the ports 1008. This can result in debris accumulating between the primary closing sleeve 1002 and secondary closing sleeve 1004 that can adversely affect the ability of the secondary closing sleeve 1004 to seal with the sealing surface 1020, or prevent the secondary sleeve from sealing back into the primary closing sleeve 1002. Thus, debris generated in drilling out the primary closing sleeve 1002 may prevent full sealing of the ports 1008.

SUMMARY

Embodiments described herein provide stage tools for stage treatment of a lined wellbore. According to one embodiment, a stage tool comprises a body with a longitudinal inner bore defined by a tubular wall with a fluid port, the tubular wall presenting an outer surface and an inner surface; a primary closing sleeve moveable on the outer surface from a port open position to a port closed position; and a secondary closing sleeve movable on the inner surface of the body from a port uncovered position to a port covering position.

The stage tool may also comprise an internal member joined to the primary closing sleeve and movable on the inner surface. The internal member and the primary closing sleeve, in on embodiment, are joined by a crosslink. A longitudinal channel provided in the tubular wall, can be shaped to enable travel of the crosslink when the primary closing sleeve moves from the port open position to port closed position. The internal member and the secondary closing sleeve may move along different surfaces on the internal wall to avoid interference.

According to another aspect, methods for stage treatment of a wellbore are provided. According to one embodiment, a method for stage treatment of a wellbore comprises: providing a stage tool having a body defined by a tubular wall provided with a fluid port, the stage tool comprising a port opening sleeve, a primary closing sleeve movable on the outer surface of the tubular wall and a secondary, backup closing sleeve movable on the inner surface of the tubular wall; running the stage tool into the wellbore; controllably actuating the port opening sleeve of the stage tool to open the fluid port; pumping a spacer through the inner bore, followed by fluid for stage treatment; when stage treatment is completed, controllably actuating the primary closing sleeve to slide on the outer surface of the tubular wall to assume a port closed position; and controllably actuating the secondary closing sleeve to slide on the inner surface of the tubular wall to a port covering position in the event that the primary closing sleeve fails to attain the port closed position. In another embodiment, the secondary closing sleeve may be closed even if the primary closing sleeve closes to provide a redundancy.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore non-limiting, embodiments illustrated in the drawings, wherein identical reference numerals designate the same components. Note that the features illustrated in the drawings are not necessarily drawn to scale.

DETAILED DESCRIPTION

Figure 1A:
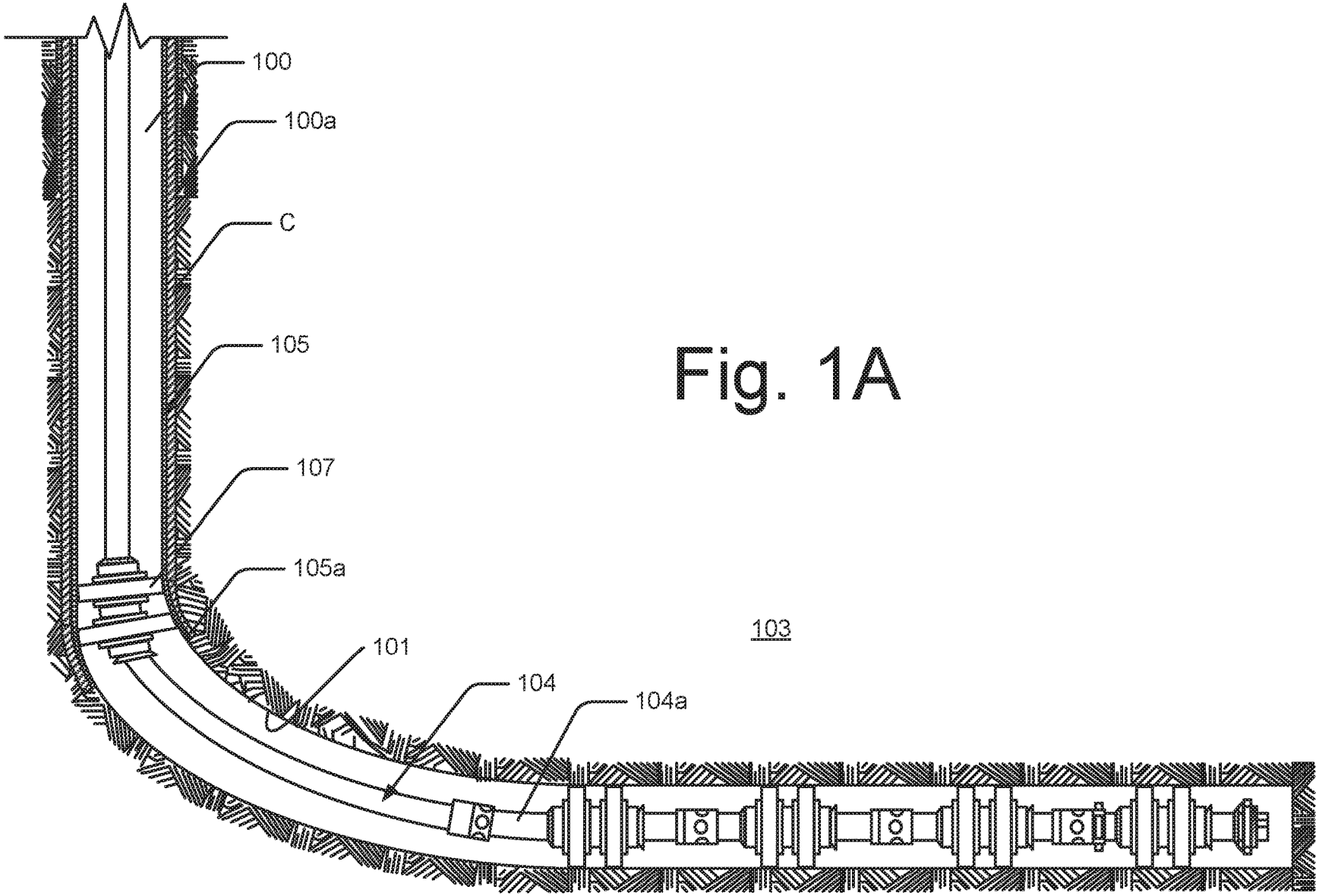
FIG. 1A is a diagrammatic representation of a schematic view through a wellbore with a tubing string installed therein.

This disclosure and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure the disclosure in detail. Skilled artisans should understand, however, that the detailed description and the specific examples, while disclosing preferred embodiments, are given by way of illustration only and not by way of limitation. Various substitutions, modifications, additions or rearrangements within the scope of the underlying inventive concept(s) will become apparent to those skilled in the art after reading this disclosure. Furthermore, any dimensions provided are given by way of example and not limitation.

Embodiments described herein provide stage tools with an enhanced closing mechanism. In accordance with one embodiment, a stage tool includes a primary closing sleeve and a secondary (backup) closing sleeve that provides independent sealing of the fluid ports from the primary closing sleeve. That is, the secondary closing sleeve is not dependent on the sealing capability of the primary closing sleeve being maintained. According to one embodiment, the stage tool further allows the secondary closing sleeve to be placed in a position so that it seals the cementing ports, without being dependent on moving the primary closing sleeve out of the way. Embodiments described herein further provide tools which reduce or prevent degradation of sealing capability caused by debris from drilling out a plug seat.

According to one embodiment, a stage tool comprises a body that defines a longitudinal inner bore and one or more ports (e.g., cement circulation ports) that extend through the wall of the body to provide fluidic access between the inner bore of the stage tool and the outer surface of the stage tool. The ports may be closed using a plurality of movable sleeves. According to one embodiment the movable sleeves include a primary closing sleeve and a secondary closing sleeve.

The primary closing sleeve is movable from a port open position in which the primary closing sleeve does not cover the fluid port(s), to a port closed position in which the primary closing sleeve covers the fluid port(s). A secondary closing sleeve may be movable from a port uncovered position in which the secondary closing sleeve does not cover the fluid port(s), to a port covering position in which the secondary closing sleeve covers the fluid port(s). The secondary closing sleeve can be independent from the primary closing sleeve in that it does not have to depend on the functioning of the primary closing sleeve to seal the port(s). The secondary closing sleeve may, for example, move between its port uncovered and port covering positions using a pathway that is unaffected by failures in or debris blockages around the primary closing sleeve, as it is positioned at or between its own port uncovered and port covering positions. In some embodiments, the secondary closing sleeve may seal at an independent sealing surface from the primary closing sleeve.

According to one embodiment, the primary closing sleeve is an external sleeve that is cross-linked to an internal member, which includes, for example, a plug seat for a closing plug. The internal member can be movable from a first position corresponding to the primary closing sleeve port open position to a second position, corresponding to the primary closing sleeve port closed position. The primary closing sleeve can be axially movable as the internal member is moved by the action of a plug. Further, in accordance with one embodiment, the secondary closing sleeve is an internal closing sleeve.

The stage tool may also include a port opening sleeve slidable from a port closing position in which the port opening sleeve covers the fluid port(s), to a port opening position in which the port opening sleeve does not cover the fluid port(s). The port opening sleeve may be an internal or external sleeve. According to one embodiment, the port opening sleeve is a hydraulically actuated sleeve. According to another embodiment, the port opening sleeve is a plug activated sleeve.

Figure 1B:
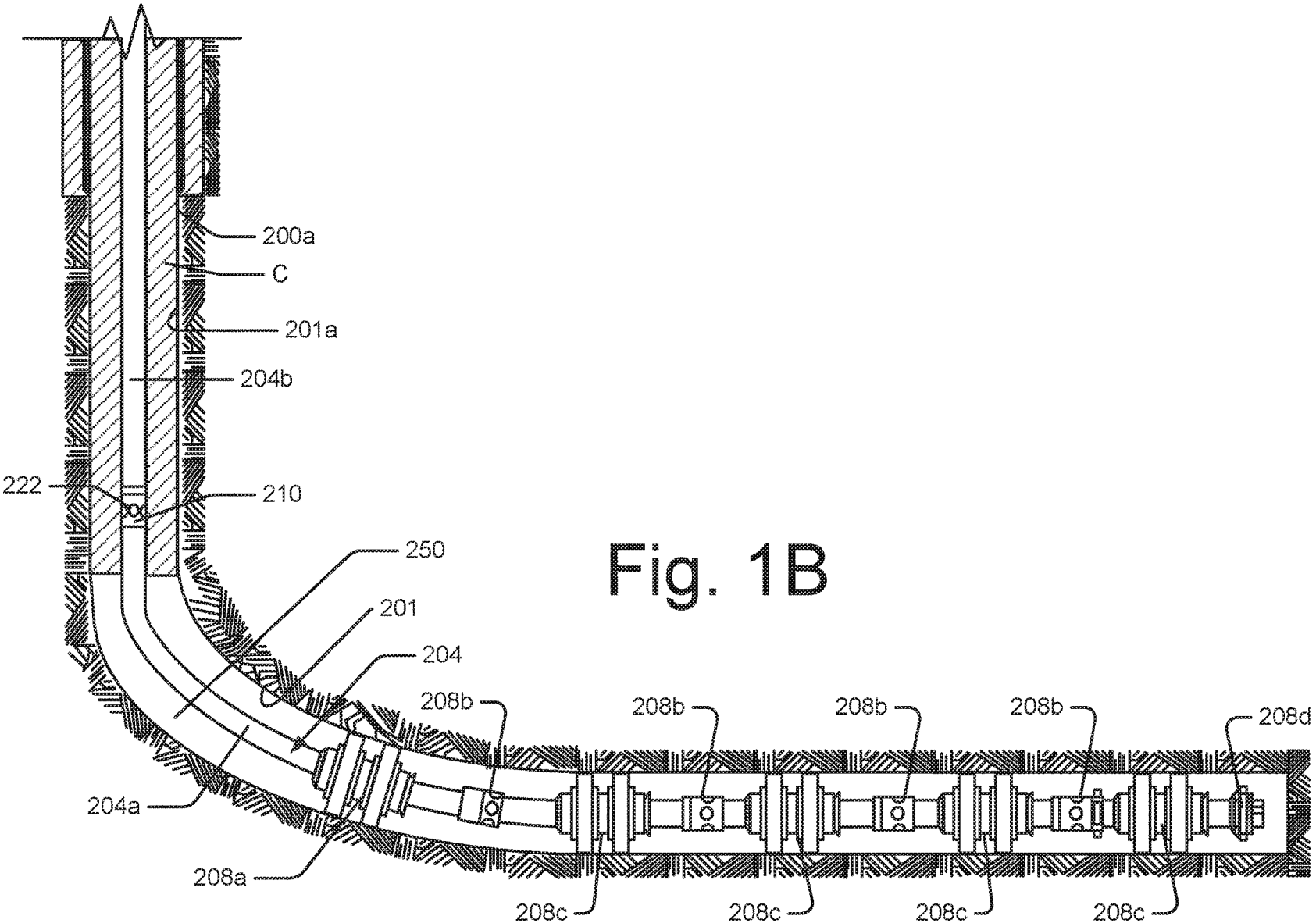
FIG. 1B is a diagrammatic representation of a schematic view through a wellbore with another embodiment of a tubing string installed therein.

Before proceeding further, FIGS. 1A and 1B are provided for a more general context. In wellbore operations, for example, as shown in these Figures, generally a surface hole is drilled and surface casing 100 is installed and cemented in place to protect surface soil and ground water from wellbore operations and to prevent cave in. Thereafter, an extended wellbore 101 is drilled below the surface casing point 100*a*, to reach a formation of interest 103. Where operations are to be conducted using a liner 104, in prior art operations, as shown in FIG. 1A, often the extended wellbore 101 is also cased, in for example being lined with one or more casing strings 105, and often cemented by introduction of cement C into the annulus, to provide well control and isolation down to the liner 104. The liner 104 is then set, as by use of a liner hanger 107 secured against the cased section of the well. The active, lower portion 104*a* of the liner 104 may extend in the casing and/or out beyond the casing point 105*a* at the bottom of the cased section of the well. As will be appreciated by those skilled in the art, any time the well must be cased and cemented below the surface casing, significant financial and time costs are added to the operation. Also, the introduction of various cased sections decreases the available inner diameter space of the liner. In particular, the permissible diameter of any liner becomes smaller, as the number of casing installations increases.

With reference to FIG. 1B, a process and installation are provided that permit a liner 204 to be supported in an extended wellbore 201 by stage cementing below any casing point 200*a* of surface casing, as shown, or possibly below a casing point of a lower section of casing. The liner 204, therefore, can be installed by cementing the annulus about the liner 204 in an open hole, uncased section of the well. A stage tool 210 is installed in the liner 204, which separates the string into an upper portion 204*b*, above the stage tool 210, and a lower portion 204*a*, below the stage tool 210, containing active components 208*a*, 208*b*, 208*c* and 208*d* of the liner 204. Cement C may be introduced along the length of the liner 204 at the position of the stage tool 210 to cement, and therefore seal off, the annulus 250 between the liner 204 and the open hole wall 201*a*. The cement may be introduced to fill a selected portion of the annulus, for example, to create a column extending back to the lowest cased section of the well.

Active components 208*a*, 208*b* 208*c* and 208*d* may take various forms such as, for example, selected from one or more of packers, slips, stabilizers, centralizers, fluid treatment intervals (such as may include fluid treatment ports, nozzles, port closures, etc.), fluid production intervals (such as may include fluid inflow ports, screens, inflow control devices, etc.), etc. For example, in one embodiment active components may include slips 208*a*, multistage fracturing components, sleeve valves, hydraulic ports 208*b*, packers 208*c* for zone isolation, blow out devices, 208*d*, etc. Various of these active components are described in applicant's patents such as U.S. Pat. No. 6,907,936, issued Jun. 21, 2005 and U.S. Pat. No. 7,108,067, issued Sep. 19, 2006, each of which is hereby fully incorporated by reference herein.

The liner 204 may be run in and positioned in the well by various procedures. In one embodiment, the liner 204 is run into a selected position and set by slips and/or packers in the well. In one embodiment, for example, after the liner 204 is run in, a ball is launched to close the liner 204 such that it can hold pressure. Alternately, the liner 204 may be run in with a blowout plug already permitting the liner to hold pressure. Alternately, the liner 204 may include a port opened by pressure cycling, such that once downhole, the liner 204 can be pressured up and pressure released to open the liner 204. An example of such a pressure cycle valve is shown in applicant's corresponding application WO 2009/132462, published Nov. 5, 2009, which is hereby fully incorporated by reference herein. Thereafter, or during the pressure manipulation process which opens the liner 204, the liner 204 is pressured up to set the packers and/or slips.

Stage tool 210 includes one or more ports 222 that may be opened to permit cement to flow out therethrough. The port opening operation may be achieved in various ways. In one embodiment, port opening occurs by hydraulics, as by bursting or pressure driving closures such as gates or sleeves. Alternately, the port opening operation may be accomplished by mechanical means such as by landing a plug to actuate the tool.

After the stage tool's circulation ports 222 are opened, cement may be pumped therethrough into the annulus. In one embodiment, a spacer (not shown) is pumped first, followed by a cement slurry, another spacer and finally a displacement fluid. After its introduction to the annulus, cement may be held in the annulus until it sets. While various means may be employed to maintain the cement in the annulus, generally the stage tool 210 includes or works with a port closing mechanism that closes the ports 222. The stage tool 210 and port closing mechanism may take various forms. For example, the stage tool 210 may include a mechanical closure that can be manipulated to seal off ports 222. Alternately, the stage tool 210 may operate with plugs that are launched to close off the ports 222.

The stage tool 210 that operates by the launching of plugs may include ports 222 that are openable by some operation, such as using mechanically or hydraulically actuated mechanisms. Once the ports 222 are opened, cement can be pumped down into the stage tool 210 and out through its ports 222 to the annulus. A spacer can then be pumped followed by displacement fluid. The stage tool 210 may further include a plug receptacle, wherein a plug is launched to land in the stage tool 210 to actuate a port closing mechanism.

Figure 2:
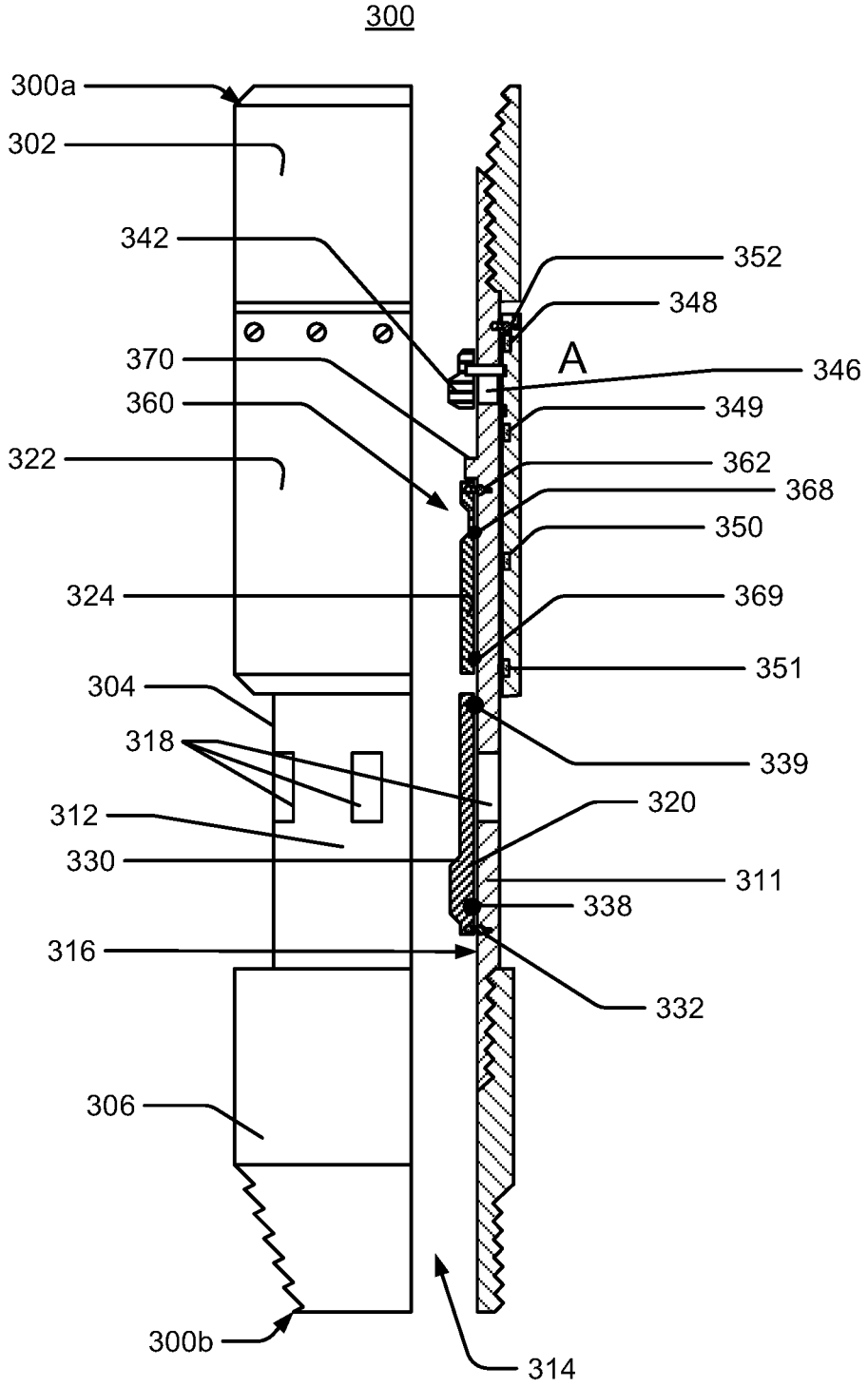
FIG. 2 is a diagrammatic representation of a one embodiment of a stage tool.

FIG. 2 is a diagrammatic representation of one embodiment of a stage tool 300 for installation in a wellbore, such as for example stage tool 210 shown in FIG. 2B. Stage tool 300 comprises a tubular body formed from one or more tubulars e.g., such as an upper connection 302, housing 304 and lower connection 306. The body has a wall 311 with an outer surface 312 and an inner surface 316. An inner bore 314 defined by inner surface 316 extends from an upper end 300*a* to a lower end 300*b* of stage tool 300. Cement circulation ports 318 extend through wall 311. As is understood in the art, terms such as "upper" and "lower" are relative terms with respect to the surface end of the liner with, for example, an "upper" component being closer to the surface end than a corresponding "lower" component. The terms "above", "below", "down", "up" "downwards", "upwards", and the like, as used by the skilled in the art, are relative terms, which specify the direction of the movement and/or the position of the sleeves in relation with the upper end 300*a* of the stage tool.

Stage tool 300 further comprises a port opening sleeve 320, movable along the inner surface 316 in this embodiment, a primary closing sleeve 322, movable along the outer surface 312, and a secondary closing sleeve 324, movable along the inner surface 316, independent from the primary closing sleeve 322. Port opening sleeve 320 includes seals 338, 339 to seal below and above ports 318 when port opening sleeve 320 is in a port closing position as illustrated in FIG. 2. The primary closing sleeve 322 includes seals 350, 351, 348 and 349 to seal below and above ports 318 when sleeve 322 is in its port closed position. The secondary closing sleeve 324 includes seals 369 and 368 to seal with inner surface below and above ports 318 when the secondary closing sleeve 324 is in its port covering position. In the arrangement illustrated, the secondary closing sleeve 324 can independently seal ports 318 without relying on the primary closing sleeve 322.

The port opening sleeve 320 is axially movable within the stage tool 300 through a plurality of positions from a port closing position (FIG. 2) in which port opening sleeve 320 covers the inside of ports 318, to a port opening position, when the sleeve 320 does not cover the inside of ports 318. When the ports 318 are open to allow cementing, the port opening sleeve 320 is moved down the liner (i.e. away from the surface end of the liner), while the primary closing sleeve 322 is positioned above the fluid ports 318 and the secondary closing sleeve 324 is also above the fluid ports, to leave the fluid ports 318 open.

The port opening sleeve 320 may include a plug seat 330 on which a tool activation plug, such as a ball, dart or other plug, conveyed down the string can land to seal the inner bore 314. Pressure can be applied through the string from the surface to create a pressure differential across a seated plug, driving the port opening sleeve 320 down to open ports 318. The range of motion of the port opening sleeve 320 can be limited by a locking device (c-ring or other locking device), shoulder, or other feature. It is to be noted that, as used herein, the term "plug," unless otherwise specified, refers generally to a device that is capable to land on a matching receiving device (plug receptacle) to seal the inner bore. A plug may enable building of a pressure differential between the part of the inner bore above and below the plug. Plugs include, but are not limited to, balls, darts and other such devices known in the art. The term "plug seat" refers to the matching receiving device for a plug.

One or more releasable setting devices 332 may be provided to releasably hold the port opening sleeve 320 in the port closing position until the holding force of the releasable setting device 332 is overcome. Releasable setting devices 332, such as one or more of a shear pin (shown), a collet, a c-ring, or other releasable setting device, provide that the port opening sleeve 320 may be held in place against inadvertent movement out of any selected position, but may be released to move only when it is desirable to do so. In the illustrated embodiment, releasable setting devices 332 may be installed to maintain the port opening sleeve 320 in its port closing position but can be released, as in the present embodiment by shearing, when a sufficient differential pressure is established across the port opening sleeve 320 to allow movement of the port opening sleeve 320.

One or more locking mechanisms (not shown) may be provided to maintain the port opening sleeve 320 in the port open position. Dogs, a load ring, detents, a c-spring, collet or other locking mechanisms may be employed. The locking mechanism may be variously configured, such as in the form of a c-ring set in an annular groove, such as a gland, and normally biased outwardly but locked between the port opening sleeve 320 and the wall 311. More particularly, in one embodiment, a locking ring (e.g., such as a c-ring) may be captured in an annular groove about sleeve 320. The inner surface 316 of the tool may include an indent, such as groove, into which the locking ring can partially expand when the locking ring overlaps the groove. In one embodiment, the locking mechanism may releasably lock the port opening sleeve 320 in the port open position.

One or more seals 338, 339 may be provided to deter fluid leakage to/from inner bore 314 between the port opening sleeve 320 and the wall 311 when the port opening sleeve 320 is in the port closing position. It will be appreciated that annularly extending seals may be particularly useful. Seals 338, 339 may take various forms and be formed of various materials, such as, for example, various combinations of elastomerics, metals, rings, O-rings, chevron or v-seal stacks, wiper seals, or other type of seal.

The primary closing sleeve 322 may be installed on the tool to be axially moveable relative to the housing 304. The primary closing sleeve 322 may be axially moveable through a plurality of positions. For example, as presently illustrated, the primary closing sleeve 322 may be moveable from a port open position in which the primary closing sleeve 322 does not cover the ports 318 (FIG. 2) to a port closed position in which the primary closing sleeve 322 covers the ports 318. The installation site for the primary closing sleeve in the tubular segment is formed to allow for such movement.

Figure 2A:
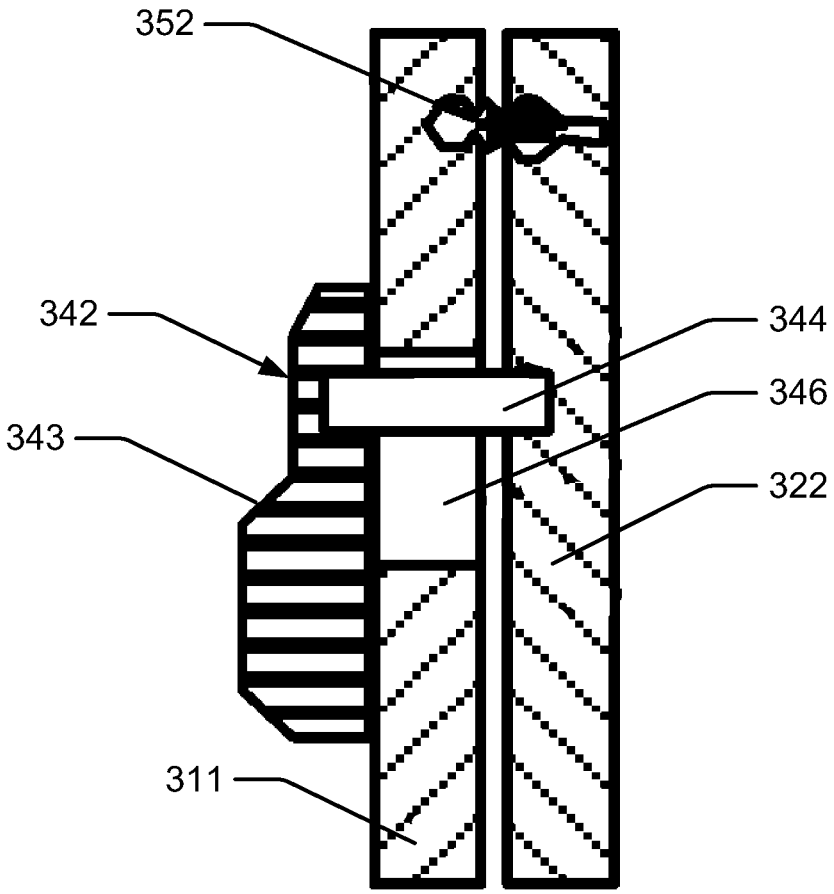

As shown in FIG. 2A, the primary closing sleeve 322 is coupled to an internal member 342 by a crosslink 344 (e.g., post, pin, bolt, dogs or other link member) that passes through a channel 346 in the wall 311. The internal member 342 provides a mechanism to allow shifting of the primary closing sleeve 322 by a tool or plug conveyed within the string. According to one embodiment, the internal member 342 may include features to allow a shifting tool to close the primary closing sleeve 322. In another embodiment, the internal member 342 comprises a plug seat 343 on which a plug, such as a ball, dart or other plug, conveyed down the string can land. Pressure can be applied through the string from the surface to create a pressure differential across a seated plug, driving internal member 342 down.

Force from the internal member 342 will be transferred to external primary closing sleeve 322 through crosslink 344, causing the primary closing sleeve 322 to move from the port open position to the port closed position. Crosslink 344 can travel in channel 346. The range of movement of primary closing sleeve 322 can be limited by a shoulder or other features that limits the movement of the internal member 342 or the primary closing sleeve 322, crosslink 344 abutting the end of channel 346, a locking mechanism or other mechanism for limiting movement. In one embodiment, the internal member 342 may be sized and positioned so that it does not move across the ports 318.

One or more releasable setting devices 352 may be provided to releasably hold primary closing sleeve 322 in the port open position (FIG. 2) until the holding force of the releasable setting device 352 is overcome. Releasable setting devices 352, such as one or more of a shear pin (shown), a collet, a c-ring, or other releasable setting device, provide that the sleeve 322 may be held in place against inadvertent movement out of any selected position, but may be released to move only when it is desirable to do so. In the illustrated embodiment, releasable setting devices 352 may be installed to maintain the primary closing sleeve 322 in its port open position but can be released, as in the present embodiment by shearing, when a sufficient differential pressure is established across the primary closing sleeve 322 to allow movement of the primary closing sleeve 322. While, in the illustrated embodiments, releasable setting devices 352 are illustrated to hold between the primary closing sleeve 322 and the tubular body, in another embodiment releasable setting devices 352 may hold between internal member 342 and the tubular body.

One or more locking mechanisms (not shown) may be provided to maintain the primary closing sleeve 322 in the port closed position. Dogs, a load ring, detents, a c-spring, collet or other locking mechanisms may be employed. The locking mechanism may be variously configured, such as in the form of a c-ring set in a groove, such as a gland, and normally biased inwardly but locked between the primary closing sleeve 322 and the wall 311. In the port closed position, the c-ring may align with and partially extend into a groove on the outer surface 312 to lock the primary closing sleeve 322 in the port closed position. In another embodiment, a c-ring or other locking device may be disposed between internal member 342 and wall 311. The locking mechanism may releasably lock primary closing sleeve 322 in the port covering position.

As indicated above, one or more seals 348, 349, 350, 351 may be provided to deter fluid leakage to/from the inner bore 314 between the wall 311 and external primary closing sleeve 322. In the arrangement illustrated, seals 348 and 349 are spaced to deter leakage at channels 346 when the primary closing sleeve 322 is in the port open position and port closed position. Seals 349 and 350 are spaced to deter leakage at ports 318 when the port opening sleeve 320 is in a port covering position. It will be appreciated that annularly extending seals may be particularly useful. Seals 348, 349, 350 and 351 may take various forms and be formed of various materials, such as, for example, various combinations of elastomerics, metals, rings, O-rings, chevron or v-seal stacks, wiper seals, or types of seals. If any seals must pass over contoured surfaces such as ports or glands, consideration may be given to the form and durability of the seal. For example, seals 350 and 351 during operation of the tool may pass over ports 318, which may have sharp edges, yet continue to be required to act in a sealing capacity between the external primary closing sleeve 322 and the outer surface 312. Seals 350 and 351 may, in one embodiment therefore, be bonded in its gland, such that it cannot easily be pulled or dislodged therefrom. Alternately or in addition, seals 350 and 351 may be selected to include a stack of chevron seals, the seals being formed each with a V-shaped cross section, as these seals may have a resistance to dislodging from their glands and resistance to damage greater than those of O-rings. The seals, in addition or alternately, may be formed with high-durability polymers, such as including fluoropolymer elastomers for example, a polytetrafluoroethylene (Teflon™), a hexafluoropropylene-vinylidene fluoride co-polymer (Viton™), an alternating copolymer of tetrafluoroethylene and propylene (Aflas™), or other material. According to one embodiment, seal 350 is an elastomeric seal and seal 351 is an inward facing v-stack.

The secondary closing sleeve 324 is axially movable within the stage tool 300 through a plurality of positions from a port uncovered position (FIG. 2) in which the secondary closing sleeve 324 does not cover the inside of ports 318, to a port covering position in which the secondary closing sleeve 324 covers the inside of ports 318. The secondary closing sleeve 324 may include one or more shift profiles such as shown on FIG. 2 by features 360 with which a shifting tool, such as an OTIS B shifting tool, may engage to move the secondary closing sleeve 324 from the port uncovered position to a port covering position. The range of motion of the secondary closing sleeve 324 can be limited by a locking device (c-ring or other locking device), shoulder, top of port opening sleeve 320 or other feature.

It can be noted that in the configuration of FIG. 2, the path of movement of the secondary closing sleeve 324 does not overlap that of the primary closing sleeve 322 or internal member 342. As such, there is no mechanical overlap/interference between the secondary closing sleeve 324 and the primary closing sleeve 322 or the secondary closing sleeve 324 and internal member 342. Therefore, even if the internal member 342 shifts down, the secondary closing sleeve 324 can be shifted to a port covering position without moving another sleeve out of the way (assuming the ports are open). Moreover, the secondary closing sleeve 324 does not have to seal into another sleeve. Therefore, any debris accumulated in the region of ports 318 are less likely to affect the ability of the secondary closing sleeve 324 to seal the ports 318.

One or more releasable setting devices 362 may be provided to releasably hold the secondary closing sleeve 324 in the port uncovered position (FIG. 2) until the holding force of the releasable setting devices 362 is overcome. Releasable setting devices 362, such as one or more of a shear pin (shown), a collet, a c-ring, or other releasable setting device, provide that the secondary closing sleeve 324 may be held in place against inadvertent movement out of any selected position, but may be released to move only when it is desirable to do so. In the illustrated embodiment, releasable setting devices 362 may be installed to maintain the secondary closing sleeve 324 in its port uncovered position but can be released, as in the present embodiment by shearing, when a sufficient differential pressure is established across the sleeve to allow movement of the sleeve.

One or more locking mechanisms (not shown) may be provided to maintain the secondary closing sleeve 324 in the port covering position. Dogs, a load ring, detents, a c-spring, collet or other locking mechanisms may be employed. The locking mechanism may be variously configured, such as in the form of a c-ring set in an annular groove, such as a gland, and normally biased outwardly but locked between the secondary closing sleeve 324 and the wall 311. More particularly, in one embodiment, a locking ring (e.g., such as a c-ring) may be captured in an annular groove about the secondary closing sleeve 324. The inner surface 316 may include an indent, such as groove, into which the locking ring can partially expand when the locking ring overlaps the groove. In one embodiment, the locking mechanism may releasably lock the secondary closing sleeve 324 in the port covering position.

As indicated above, one or more seals 368, 369 may be provided to deter fluid leakage to/from inner bore 314 between the secondary closing sleeve 324 and the wall 311 when the secondary closing sleeve 324 is in the port covering position. It will be appreciated that annularly extending seals may be particularly useful. Seals 368, 369 may take various forms and be formed of various materials, such as, for example, various combinations of elastomerics, metals, rings, O-rings, chevron or v-seal stacks, wiper seals, or other type of seal. If any seals must pass over contoured surfaces such as ports or glands, consideration may be given to the form and durability of the seal. For example, seal 369 during operation of the tool may pass over ports 318, which may have sharp edges, yet continue to be required to act in a sealing capacity between the secondary closing sleeve 324 and the inner surface 316. Seal 369 may, in one embodiment therefore, be bonded in its gland, such that it cannot easily be pulled or dislodged therefrom. Alternately or in addition, seal 369 may be selected to include a stack of chevron seals, the seals being formed each with a V-shaped cross section, as these seals may have a resistance to dislodging from their glands and resistance to damage greater than those of O-rings. The seals, in addition or alternately, may be formed with high-durability polymers, such as including fluoropolymer elastomers for example, a polytetrafluoroethylene (Teflon™), a hexafluoropropylene-vinylidene fluoride co-polymer (Viton™), an alternating copolymer of tetrafluoroethylene and propylene (Aflas™), or other material.

In operation, stage tool 300 can be run-in in the configuration illustrated in FIG. 2 with port opening sleeve 320 covering the inner side of ports 318. Stage tool 300 can be run in the well along with the pipe and placed at the depths of cement circulation. When the operator desires to open stage tool 300, the operator can gravity drop a weighted plug sized to land on plug seat 330 of the port opening sleeve 320. When the plug has landed, the operator can pressure up the string to a desired pressure, causing the port opening sleeve 320 to shift down, opening ports 318. Opening ports 318 uncovers an extra sealing area that is now available for the secondary closing sleeve 324 to move across. Cement, cement spacers and cement slurry can be pumped down the string as needed based on the operation.

When it is desired to close the ports of the stage tool 300, the operator can launch a closing plug sized to land on internal member 342. The closing plug can be pumped down the string after cement or a cement spacer with water or appropriate displacement fluid. When the closing plug has landed, the operator can pressure up the string. When a sufficient pressure is reached, releasable setting devices release, allowing internal member 342 to shift the primary closing sleeve 322. According to one embodiment, the string can be pressured up to approximately 1500 PSI above the cement hydrostatic lift pressure to shift the primary closing sleeve 322.

A stopping point can be provided (e.g., internal to the tool) so that the force of sleeve 322 moving to the port closed position does not break or shear off the crosslink 344. According to one embodiment, all of the force is taken by this stopping point and not by the external primary closing sleeve 322 or crosslinks 344. For example, the stopping point could be a shoulder or other stopping point, such as shoulder 370. When the internal member 342 lands, the primary closing sleeve 322 will be properly positioned and a locking device 454 can lock the primary closing sleeve 322 in the port closed position. The locking device may be a c-ring, a mandrel lock, ratcheting device, or any other type of locking device.

If the primary closing sleeve 322 does not appropriately close the ports 318 or if redundant sealing is desired, the secondary closing sleeve 324 can be closed. According to one embodiment, prior to closing the secondary closing sleeve 324, the closing plug and internal member 342 are drilled out. A shift tool can be run-in to shift the secondary closing sleeve 324 to its port covering position covering the inside of ports 318. Once in its port covering position, a locking mechanism can lock the secondary closing sleeve 324 in the port covering position.

It can be noted that in the configuration of FIG. 2, the primary closing sleeve 322 and the secondary closing sleeve 324 have independent sealing surfaces. Use of the secondary closing sleeve does not require removal of debris or removal of another sleeve in the sealing area of the secondary closing sleeve 324. A person of ordinary skill in the art would understand, however, that some jetting or clean up might be required to ensure that the sealing surface is clear of debris, cement, drilling mud, etc. so that when the secondary closing sleeve 324 shifts closed it will maintain seal integrity.

Figure 3A:
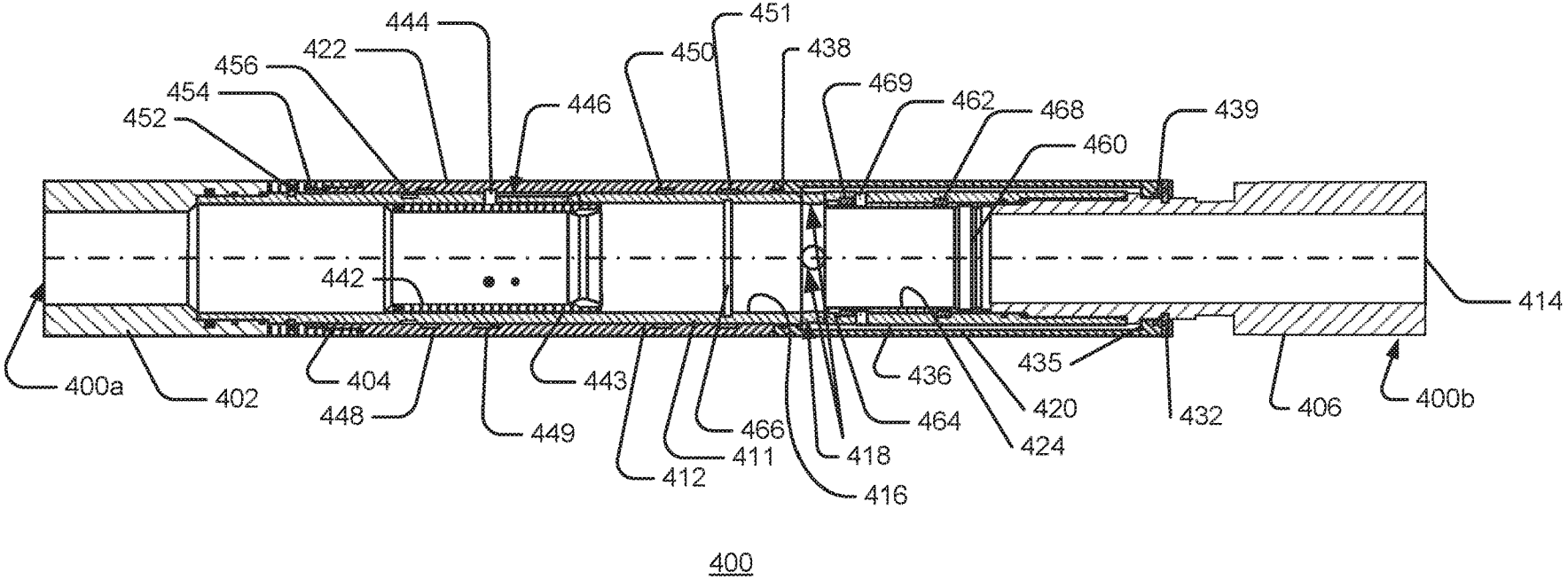
FIGS. 3A-3D are diagrammatic representations of another embodiment of a stage tool in various stages of operation.

FIG. 3A shows an embodiment of a stage tool 400 for installation in a wellbore as, for example, a stage tool 210 of FIG. 1. A port opening sleeve like sleeves 320 in FIGS. 2 and 420 in FIG. 3A may be installed in various ways on or in the tubular segment of the tool body and may take various forms, while being axially moveable along a length of the tubular segment. For example, as illustrated in FIG. 3A, sleeve 420 may be installed on the outer surface but, again, its position may be selected, as desired.

Stage tool 400 comprises a tubular body formed from one or more tubulars, such as an upper connection 402, a housing 404 and a lower connection 406. The body has a wall 411 with an outer surface 412 and an inner surface 416. An inner bore 414, defined by inner surface 416, extends from an upper end 400*a* to a lower end 400*b* of stage tool 400. Cement circulation ports 418 extend through wall 411. Stage tool 400 further comprises a port opening sleeve 420, a primary closing sleeve 422 and a secondary closing sleeve 424 independent from the primary closing sleeve 422.

Figure 3B:
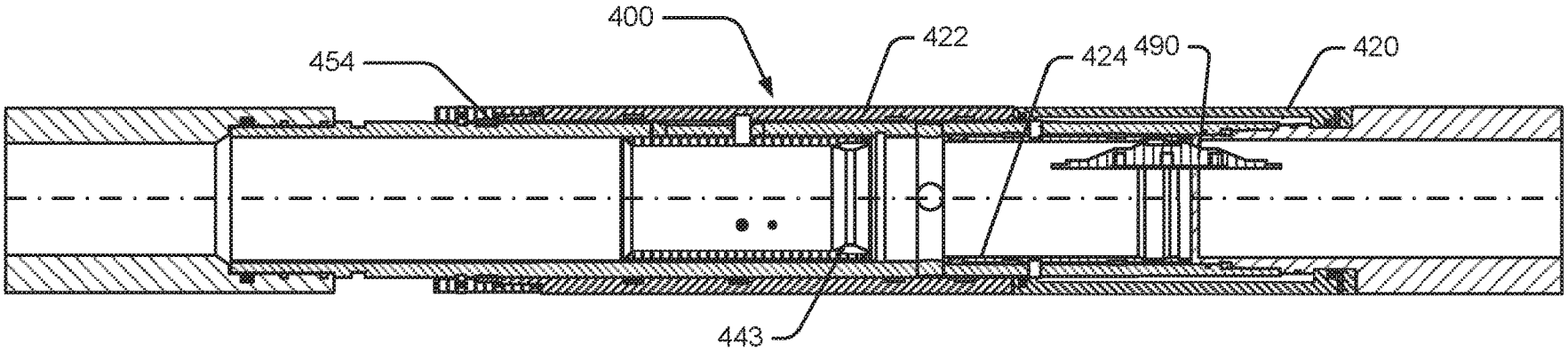

In the illustrated embodiment, the port opening sleeve 420 acts as the removable closure and is arranged to slide on the outer face of the housing 404. The port opening sleeve 420 may be installed on the tool to act as a piston, in other words to be axially moveable relative to the tubular segment at least some movement of which is driven by fluid pressure. The port opening sleeve 420 may be axially moveable through a plurality of positions. For example, as illustrated in FIG. 3A, the port opening sleeve 420 is being moved from a port closing position where it covers the fluid port 418, to a port opening position, not covering the ports 418, as shown in FIG. 3B. The installation site for the sleeve in the tubular segment is formed to allow for such movement. FIG. 3B also shows the locking mechanism for the primary closing sleeve 422, which is a c-ring 454 in this embodiment, locking the primary closing sleeve 422 in the port open position. The secondary closing sleeve 424 is also in a port uncovered position in FIG. 3B.

The port opening sleeve 420 may include a piston face 435 in communication, for example through ports 418 and gap 436, with the inner bore 414 of the tubular body such that piston face 435 is exposed to tubing pressure. The other side of the sleeve is in communication with the outer surface 412 of the tubular body and therefore open to annulus pressure. As such, a pressure differential can be set up at piston face 435 by increasing tubing pressure to move the sleeve. Piston face 435 is positioned such that a pressure differential drives the sleeve away from the port closing position to the port opening position.

Seals 438, 439 may be provided to limit leakage from inner bore 414 past the port opening sleeve 420, when it is in the port closing position. It will be appreciated that annularly extending seals may be particularly useful. Seals 438, 439 may take various forms and be formed of various materials, such as, for example, various combinations of elastomerics, metals, rings, O-rings, chevrons, wiper seals, or other type of seal.

One or more releasable setting devices 432 may be provided to releasably hold the port opening sleeve 420 in the port closing position. Releasable setting devices 432, such as one or more of a shear pin (a plurality of shear pins are shown), a collet, a c-ring, or other releasable setting device, provide that the sleeve may be held in place against inadvertent movement out of any selected position, but may be released to move only when it is desirable to do so. In the illustrated embodiment, releasable setting devices 432 may be installed to maintain the sleeve in its port closing position but can be released, as in the present embodiment by shearing, by differential pressure across face 435 to allow movement of the sleeve. Selection of a releasable setting device, such as shear pins to be overcome by a pressure differential is well understood in the art. In the present embodiment, the rating and number of shear pins may be selected with reference to the tubing pressure that is desired to be applied to move the sleeve.

If desired, a driver (not shown) may be provided to assist movement of the port opening sleeve 420 into the port open position. The driver may be selected to be unable to move the sleeve until releasable setting devices 432 are released. Since the driver is unable to overcome the holding power of releasable setting devices 432, the driver can only move the sleeve once the releasable setting devices are released. Since the driver cannot overcome the holding pressure of releasable setting devices 432 but the differential pressure can overcome the holding force of devices 432, it will be appreciated then that the driver may apply a driving force less than the force exerted by the differential pressure such that the driver may also be unable to overcome or act against a differential pressure sufficient to overcome devices 432. The driver may take various forms. For example, in one embodiment, the driver may include a spring and/or a gas pressure chamber to apply a push or pull force to the sleeve.

One or more locking mechanisms (not shown) may be provided to maintain the port opening sleeve 420 in the port opening position. Dogs, a load ring, detents, a c-spring, collet or other locking mechanisms may be employed. The locking mechanism may be variously configured, such as in the form of a c-ring set in an annular groove, such as a gland, and normally biased inwardly but locked between the port opening sleeve 420 and the wall 411. More particularly, in one embodiment, a locking ring (e.g., such as a c-ring) may be captured in an annular in the inner surface of the port opening sleeve 420. The outer surface 412 may include an indent, such as groove, into which the locking ring can partially extend when the locking ring overlaps the groove. In one embodiment, the locking mechanism may releasably lock the port opening sleeve 420 in the port open position. In another embodiment, a shoulder or other feature may prevent the port opening sleeve 420 from closing ports 418.

The primary closing sleeve 422 may be installed on the tool to be axially moveable relative to the tubular segment (housing) 404. Sleeve 422 may be axially moveable on the outer face 412 of the tubular segment through a plurality of positions. For example, as presently illustrated, the primary closing sleeve 422 may be moveable from a port open position in which the primary closing sleeve 422 does not cover the ports 418 (FIG. 3A) to a port closed position in which the primary closing sleeve 422 covers ports 418 as seen in FIG. 3B. The installation site for the sleeve in the tubular segment is formed to allow for such movement.

The primary closing sleeve 422 is coupled to an internal member 442 by a crosslink 444 (e.g., post, pin, bolt, dogs or other crosslink member) that passes through a channel 446 in wall 411. Internal member 442 provides a mechanism to allow shifting of the primary closing sleeve 422 by a tool or plug conveyed with in the string. According to one embodiment, internal member 442 may include features to allow a shifting tool to close the primary closing sleeve 422. In another embodiment, internal member 442 comprises a plug seat 443 on which a closing plug, such as a ball, dart or other plug, conveyed down the string can land. Pressure can be applied through the string from the surface to create a pressure differential across a seated plug, driving internal member 442 down.

Force from internal member 442 will be transferred to external primary closing sleeve 422 through crosslink 444, causing the primary closing sleeve 422 to move from the port open position to the port closed position. Crosslink 444 can travel in channel 446. The range of movement of the primary closing sleeve 422 can be limited by a shoulder or other features that limits the movement of internal member 442 or the primary closing sleeve 422, crosslink 444 abutting the end of channel 446, a locking mechanism or other mechanism. In one embodiment, internal member 442 may be sized and positioned so that it does not move across ports 418 when the primary closing sleeve 422 is in the port closed position.

One or more releasable setting devices 452 may be provided to releasably hold the primary closing sleeve 422 in the port open position (FIG. 3A) until the holding force of the releasable setting device 452 is overcome. Releasable setting devices 452, such as one or more of a shear pin (a plurality of shear pins are shown), a collet, a c-ring, or other releasable setting device, provide that the primary closing sleeve 422 may be held in place against inadvertent movement out of any selected position, but may be released to move only when it is desirable to do so. In the illustrated embodiment, releasable setting devices 452 may be installed to maintain the primary closing sleeve 422 in its port open position but can be released, as in the present embodiment by shearing, when a sufficient differential pressure is established across the sleeve allow movement of the sleeve. While, in the illustrated embodiments, releasable setting devices 452 are illustrated to hold between the primary closing sleeve 422 and the tubular body, in another embodiment the releasable setting devices 452 may hold between internal member 442 and the tubular body.

One or more locking mechanisms 454 may be provided to maintain the primary closing sleeve 422 in the port closed position. Dogs, a load ring, detents, a c-spring, collet or other locking mechanisms may be employed. The locking mechanism may be variously configured, such as in the form of a c-ring set in a groove, such as a gland, and normally biased inwardly but locked between the primary closing sleeve 422 and the wall 411. In the port closed position (FIG. 3B), the c-ring may align with and partially extend into a groove 456 on the outer surface 412 to lock the primary closing sleeve 422 in the port closed position. In another embodiment, a c-ring or other locking mechanism may be disposed between the internal member 442 and the wall 411. The locking mechanism may releasably lock the primary closing sleeve 422 in the port closed position.

One or more seals 448, 449, 450, 451 may be provided to deter fluid leakage to/from inner bore 414 between wall 411 and external primary closing sleeve 422. In the arrangement illustrated, seals 448 and 450 are spaced to deter leakage at channels 446 when the primary closing sleeve 422 is in the port open and port closed positions. Seals 450 and 451 are spaced to deter leakage at ports 418 when the port opening sleeve 420 is in a port closed position. It will be appreciated that annularly extending seals may be particularly useful. Seals 448, 449, 450 and 451 may take various forms and be formed of various materials, such as, for example, various combinations of elastomerics, metals, rings, o-rings, chevron or v-seal stacks, wiper seals, or other type of seal. If any seals must pass over contoured surfaces such as ports or glands, consideration may be given to the form and durability of the seal. For example, seal 451 during operation of the tool may pass over ports 418, which may have sharp edges, yet continue to be required to act in a sealing capacity between external sleeve 422 and outer surface 412. Seal 451 may, in one embodiment therefore, be bonded in its gland, such that it cannot easily be pulled or dislodged therefrom. Alternately or in addition, seals 451 may be selected to include a stack of chevron seals, the seals being formed each with a V-shaped cross section, as these seals may have a resistance to dislodging from their glands and resistance to damage greater than those of O-rings. The seals, in addition or alternately, may be formed with high-durability polymers, such as including fluoropolymer elastomers for example, a polytetrafluoroethylene (Teflon™), a hexafluoropropylene-vinylidene fluoride co-polymer (Viton™), an alternating copolymer of tetrafluoroethylene and propylene (Aflas™), or other material. According to one embodiment, seal arrangement may be provided such that multiple seals pass over the ports 418. For example, seal 451 may be an elastomeric seal used in conjunction with an inward facing v-stack (not shown), as discussed in conjunction with FIG. 2.

Figure 3C:
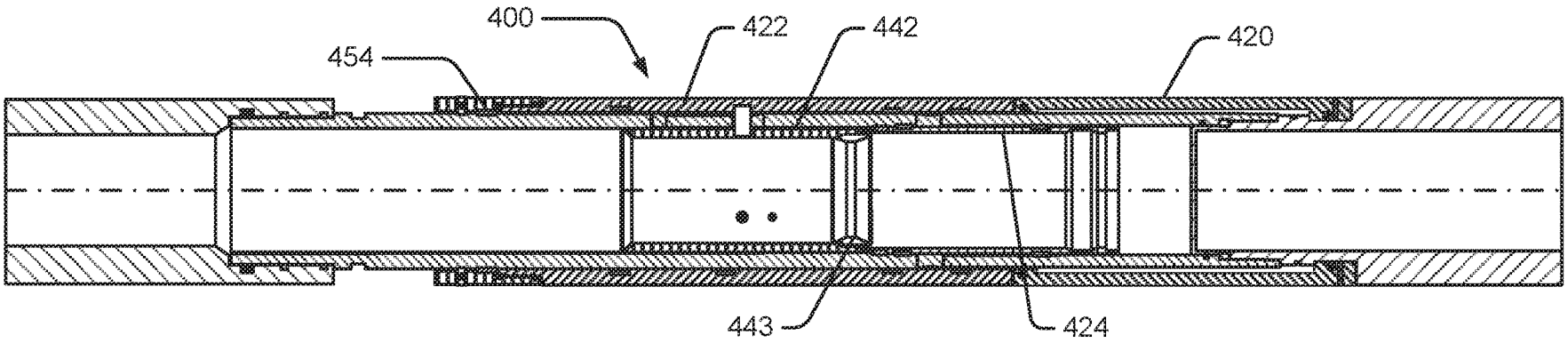

The secondary closing sleeve 424 is axially movable within stage tool 400 through a plurality of positions from a port uncovered position seen in FIG. 3A in which the secondary closing sleeve 424 does not cover the inside of ports 418, to a port covering position in which the secondary closing sleeve 424 covers the inside of ports 418 as shown in FIG. 3C. The secondary closing sleeve 424 may include one or more attaching means such as features 460, shown on FIG. 3A, with which a shifting tool, such as an OTIS B shifting tool, may engage to move the secondary closing sleeve 424 from the port uncovered position to a port covering position. The range of motion of the secondary closing sleeve 424 can be limited by a locking device (c-ring or other locking device), shoulder, top of port opening sleeve 420 or other feature.

One or more releasable setting devices 462 may be provided to releasably hold the secondary closing sleeve 424 in the port uncovered position as shown in FIG. 3A until the holding force of the releasable setting device 462 is overcome. Releasable setting devices 462, such as one or more of a shear pin (a plurality of shear pins are shown), a collet, a c-ring, or releasable setting device, provide that the sleeve 424 may be held in place against inadvertent movement out of any selected position, but may be released to move only when it is desirable to do so. In the illustrated embodiment, releasable setting devices 462 may be installed to maintain the secondary closing sleeve 424 in its port uncovered position but can be released, as in the present embodiment by shearing, when a sufficient differential pressure is established across the sleeve allow movement of the sleeve.

One or more locking mechanisms 464 may be provided to maintain the secondary closing sleeve 424 in the port covering position. Dogs, a load ring, detents, a c-spring, collet or other locking mechanisms may be employed. The locking mechanism may be variously configured, such as in the form of a c-ring set in an annular groove, such as a gland, and normally biased outwardly but locked between the secondary closing sleeve 424 and the wall 411. More particularly, in one embodiment, a locking ring (e.g., such as a c-ring) may be captured in an annular groove about the secondary closing sleeve 424. The inner surface 416 may include an indent 466, such as groove, into which the locking ring can partially expand when the locking ring overlaps the groove. In one embodiment, the locking mechanism may releasably lock the secondary closing sleeve 424 in the port covering position.

One or more seals 468, 469 may be provided to deter fluid leakage to/from inner bore 414 between the secondary closing sleeve 424 and the wall 411 when the secondary closing sleeve 424 is in the port covering position. It will be appreciated that annularly extending seals may be particularly useful. Seals 468, 469 may take various forms and be formed of various materials, such as, for example, various combinations of elastomerics, metals, rings, O-rings, chevron or v-seal stacks, wiper seals, or other type of seal. If any seals must pass over contoured surfaces such as ports or glands, consideration may be given to the form and durability of the seal. For example, seal 469 during operation of the tool may pass over ports 418, which may have sharp edges, yet continue to be required to act in a sealing capacity between the secondary closing sleeve 424 and the inner surface 416. Seal 469 may, in one embodiment therefore, be bonded in its gland, such that it cannot easily be pulled or dislodged therefrom. Alternately or in addition, seal 469 may be selected to include a stack of chevron seals, the seals being formed each with a V-shaped cross section, as these seals may have a resistance to dislodging from their glands and resistance to damage greater than those of O-rings. The seals, in addition or alternately, may be formed with high-durability polymers, such as including fluoropolymer elastomers for example, a polytetrafluoroethylene (Teflon™), a hexafluoropropylene-vinylidene fluoride co-polymer (Viton™), an alternating copolymer of tetrafluoroethylene and propylene (Aflas™), or other material.

In operation, the stage tool 400 can be run in the well along with the pipe and placed at the depth of cement circulation. Plugs (e.g., balls or other plugs) are dropped to allow pressuring up on the liner. Once a certain pressure is reached, the hydraulic port opening sleeve 420 on stage tool 400 can open. In the embodiment illustrated, shifting the port opening sleeve 420 to a port open position uncovers an extra sealing area for the primary closing sleeve 422 so that the area originally covered by the port opening sleeve 420 is now available for the primary closing sleeve 422 to move across.

Once the cement is pumped, a plug can be launched at surface behind the cement or a cement spacer with water or appropriate displacement fluid. The plug can be pumped to push the cement out the ports 418 and up around the casing. When the closing plug reaches stage tool 400 there is a restriction of diameter or a drillable seat (e.g., plug seat 443) on which the closing plug lands. When a sufficient pressure is reached, releasable setting devices 452 release, allowing internal member 442 to shift the primary closing sleeve 422. According to one embodiment, the string can be pressured up to approximately 1500 PSI above the cement hydrostatic lift pressure to shift the primary closing sleeve 422.

A stopping point can be provided (e.g., internal or external to the tool) so that the force of the primary closing sleeve 422 moving to the port closed position does not break or shear off the crosslink 444. According to one embodiment, all of the force is taken by this stopping point (e.g., a shoulder or other stopping point) and not by the crosslinks 444. When the internal member 442 or the primary closing sleeve 422 lands, the primary closing sleeve 422 will be properly positioned and a locking device (e.g., locking device 454) can lock the primary closing sleeve 422 in the port closed position. The locking device may be a c-ring, a mandrel lock, ratcheting device, or any other type of locking device.

Figure 3D:
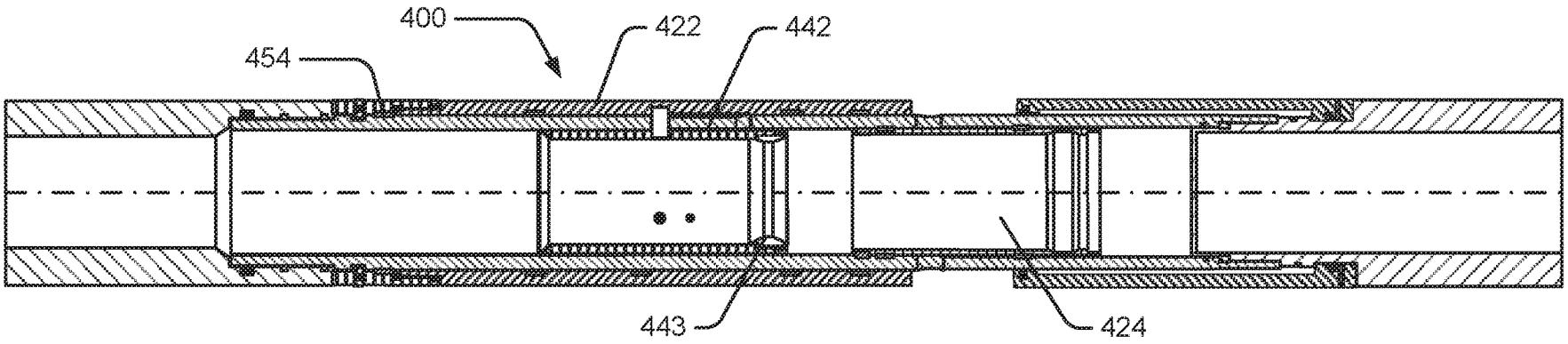

If the primary closing sleeve 422 does not appropriately close the ports 418 or if redundant sealing is desired, the secondary closing sleeve 424 can be closed. According to one embodiment, prior to closing the secondary closing sleeve 424, the closing plug and internal member 442 are drilled out (FIG. 3C, 3D). A shift tool can be run-in to shift the secondary closing sleeve 424 to its port covering position covering the inside of the ports 418. Once in its port covering position, a locking mechanism (e.g., locking mechanism 464) can lock the secondary closing sleeve 424 in the port covering position.

It can be noted that in the configuration of FIG. 3A, the primary closing sleeve 422 and secondary closing sleeve 424 have independent sealing surfaces. Use of the secondary closing sleeve 424 does not require removal of debris or removal of another sleeve in secondary closing sleeve 424's sealing area. A person of ordinary skill in the art would understand that some jetting or clean up might be required to ensure that the sealing surface is clear of debris, cement, drilling mud, etc. so that when the secondary closing sleeve 424 shifts closed it will maintain seal integrity.

FIG. 3B illustrates one embodiment of the stage tool 400 after the port opening sleeve 420 has moved to a port open position and the primary closing sleeve 422 has been moved to a port closed position. FIG. 3B also illustrates a portion of a shifting tool 490 engaged with the secondary closing sleeve 424 to shift the secondary closing sleeve 424 to a port covering position. Plug seat 443 may have to be drilled out before closing the secondary closing sleeve 424.

FIG. 3C illustrates one embodiment of stage tool 400 with plug seat 443 drilled out and the secondary closing sleeve 424 in a port covering position. In FIG. 3C, both the secondary closing sleeve 424 and the primary closing sleeve 422 are covering the ports 418. It can be noted that, while the secondary closing sleeve 424 may abut or come close to the internal member 442 in some configurations, such as shown in FIG. 3C, the internal member 442 does not interfere with the secondary closing sleeve 424. Moreover, the secondary closing sleeve 424 is not dependent on the primary closing sleeve 422 to seal the ports 418.

FIG. 3D illustrates one embodiment of stage tool 400 with plug seat 443 drilled out and the secondary closing sleeve 424 in a port covering position. In FIG. 3D, the primary closing sleeve 422 is not covering the ports 418.

Figure 4:
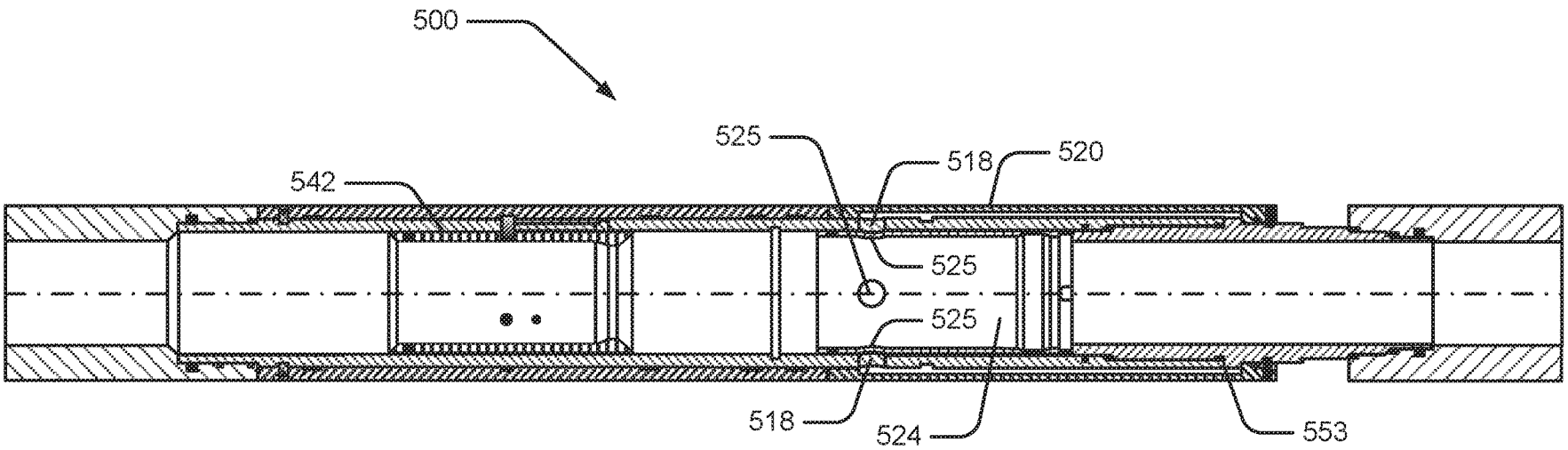
FIG. 4 is a diagrammatic representation of another embodiment of a stage tool.

FIG. 4 is diagrammatic representation of another embodiment of a stage tool 500. Stage tool 500 is similar to the stage tool 400 with some differences. In the embodiment of FIG. 4, port opening sleeve 520, primary closing sleeve 522 and internal member 542 may be similar to port opening sleeve 420 and primary opening sleeve 422. Secondary closing sleeve 524 includes ports 525 that align with the cement circulation ports 518. The secondary closing sleeve 524 is axially movable from a port uncovered position in which the ports 525 align with the cement circulation ports 518 to a port covering position in which the secondary closing sleeve 524 covers the cement flow ports. Also, the C-ring retainer is eliminated in this embodiment by moving the c-ring 454 to the lower end of the primary closing sleeve 422. Also, in this embodiment, the locking device 454 (a c-ring) is eliminated by moving it to the lower end of the primary closing sleeve 422. The ball seat in this embodiment may be made in one piece for less chance of milling debris. The larger shoulder area 553 provides a greater stiffness of the tool.

Figure 5A:
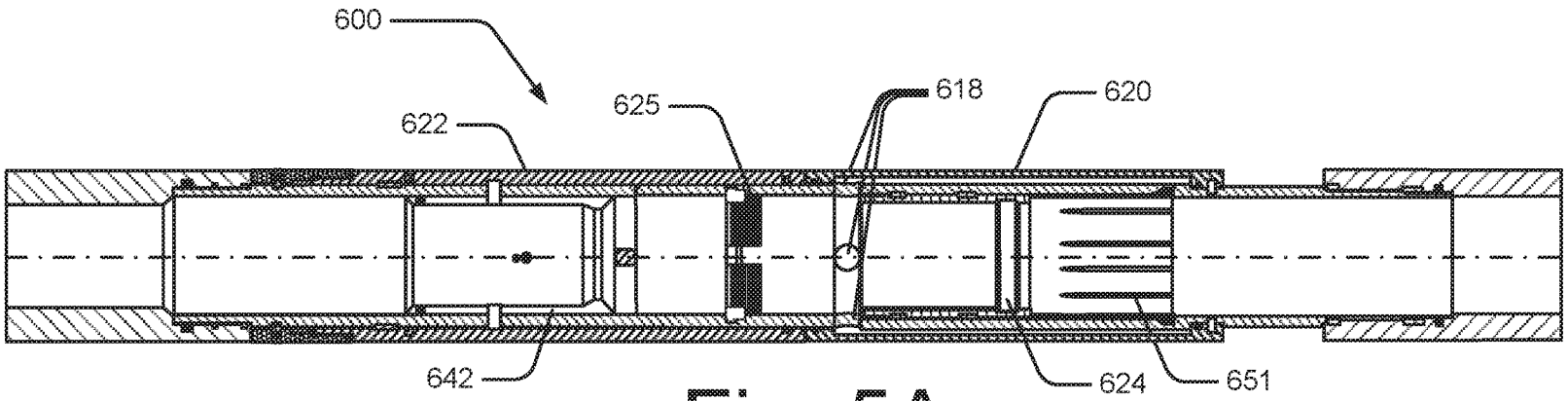
FIGS. 5A and 5B are a diagrammatic representation of yet another embodiment of a stage tool.
Figure 5B:
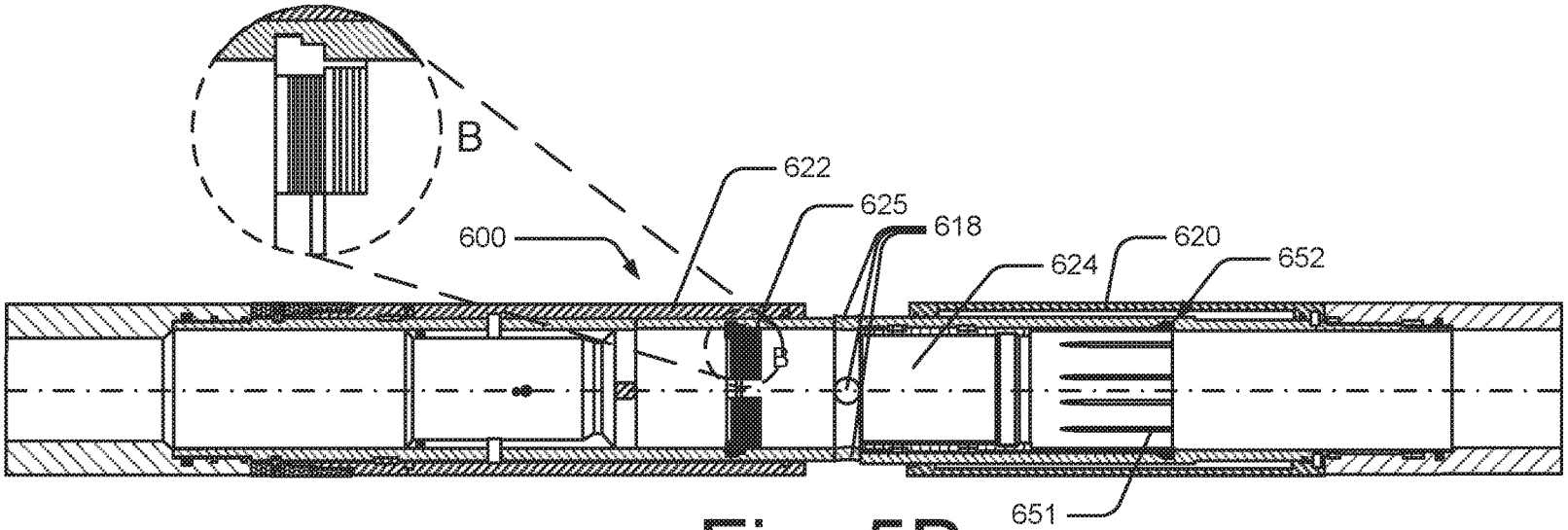

FIGS. 5A and 5B are diagrammatic representations of one embodiment of a stage tool 600 that may be similar to stage tool 400 with some differences as illustrated. Port opening sleeve 620, primary closing sleeve 622 and internal member 642 may be similar to port opening sleeve 420, primary opening sleeve 422 and internal member 442. Port opening sleeve 620 is in a port closing position in FIG. 5A and a port opening position shown in FIG. 5B. FIGS. 5A and 5B further illustrate secondary closing sleeve 624 provided with a collet locking mechanism 651 to releasably lock secondary closing sleeve 624 in a desired position. In its port open position illustrated in FIGS. 5A and 5B, extensions on the ends of the collet fingers are captured in a lower annular groove 652 to retain secondary closing sleeve 624 in place. When sufficient force is applied to secondary closing sleeve 624 (e.g., by a shifting tool), the fingers can flex inward sufficiently to allow closing sleeve 624 to shift up and cover ports 618.

FIGS. 5A and 5B further illustrate another embodiment of an internal stop 625, as seen in detail. Namely, the internal stop 625 is a stepped grove designed to prevent damage to the seals on the secondary closing sleeve 624 during installation.

Figure 6:
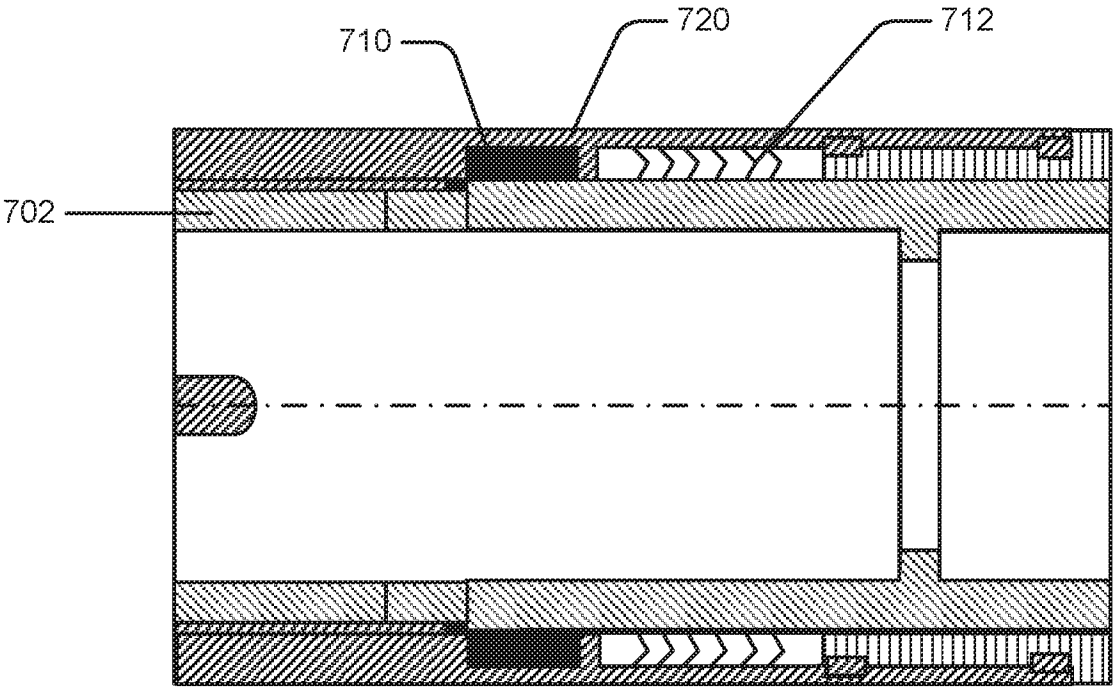
FIG. 6 is a diagrammatic representation of one embodiment of a seal arrangement.

FIG. 6 is a diagrammatic representation of a seal arrangement between a sleeve 720, for example a primary, external closing sleeve, and a tubular body 702. In the arrangement illustrated, seals 710 and 712 are seals that will pass over contoured surfaces, such as cement circulation ports that may have sharp edges. For example, this seal arrangement can be used for seals 350, 351 and 451 with an additional seal. It will be appreciated that annularly extending seals may be particularly useful. Seals 710 and 712 may take various forms and be formed of various materials, such as, for example, various combinations of elastomerics, metals, rings, O-rings, chevron or v-seal stacks, wiper seals, or other type of seal. Seals 710 and 712 may, in one embodiment therefore, be bonded in glands, such that they cannot easily be pulled or dislodged therefrom. Alternately or in addition, seals 710 and 712 may be selected to include a stack of chevron seals, the seals being formed each with a V-shaped cross section, as these seals may have a resistance to dislodging from their glands and resistance to damage greater than those of O-rings. The seals, in addition or alternately, may be formed with high-durability polymers, such as including fluoropolymer elastomers for example, a polytetrafluoroethylene (Teflon™), a hexafluoropropylene-vinylidene fluoride co-polymer (Viton™), an alternating copolymer of tetrafluoroethylene and propylene (Aflas™), etc. According to one embodiment, seal 710 may be an elastomeric seal used in conjunction with an inward facing v-stack 712.

Figure 7:
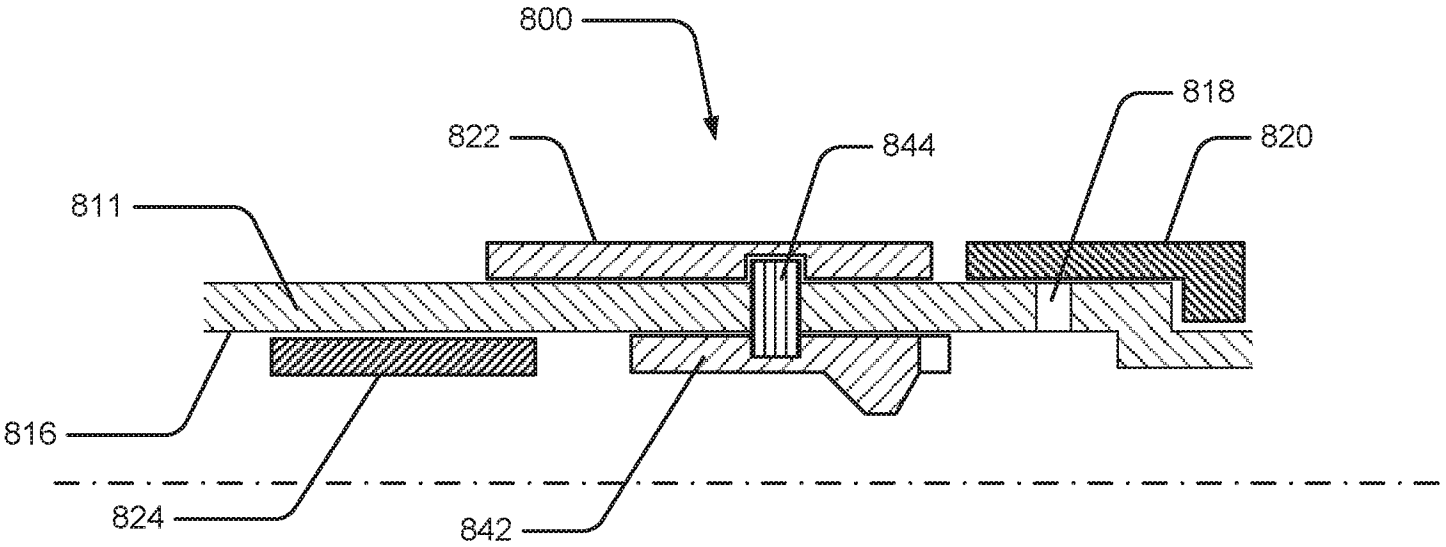
FIG. 7 is a diagrammatic representation of another embodiment of an arrangement of sleeves.
Figure 8A:
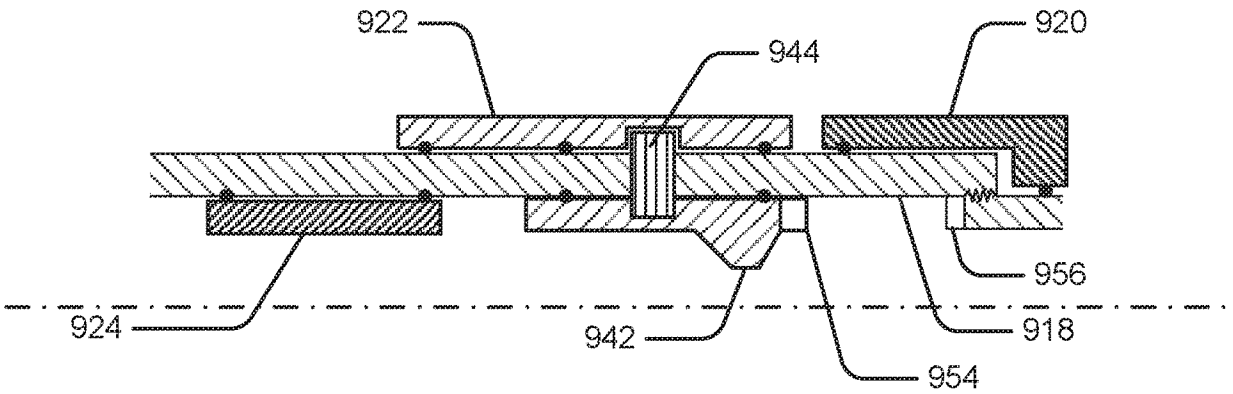
FIG. 8A is a diagrammatic representation of an arrangement of sleeves in a first configuration and FIG. 8B is a diagrammatic representation of the arrangement of sleeves in a second configuration.
Figure 8B:
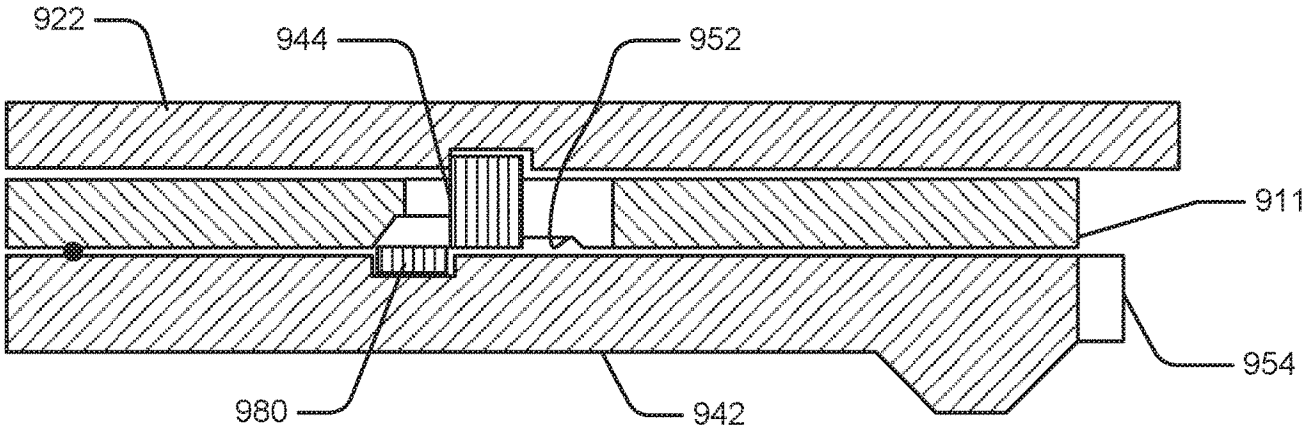
Figure 9:
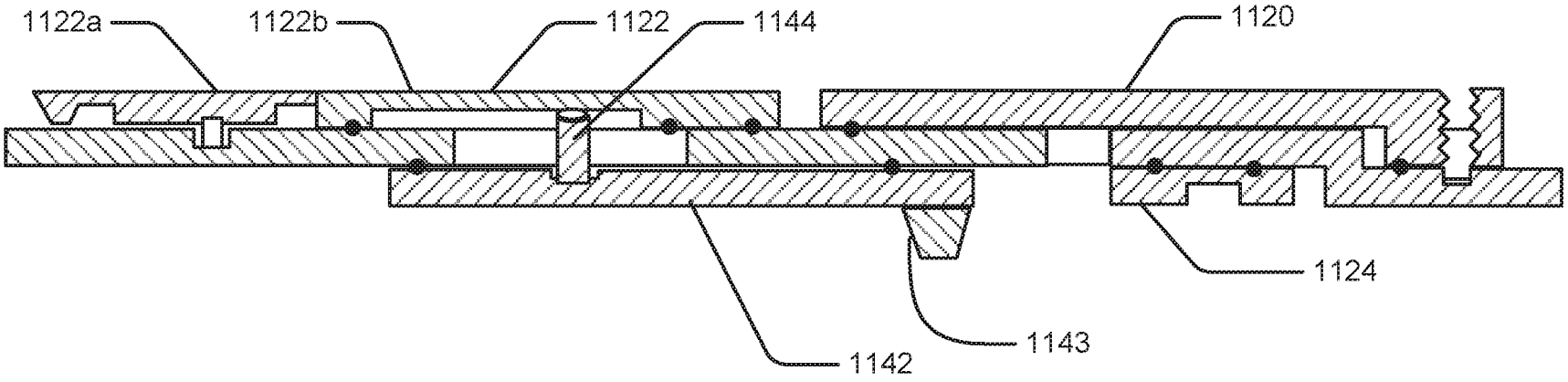
FIG. 9 is diagrammatic representation of another embodiment of a stage tool.

FIGS. 7-9 illustrate diagrammatically other arrangements of opening sleeves, internal members, primary closing sleeves and secondary closing sleeves. In the embodiment of FIG. 7, which shows a half-sectional view of a stage tool 800, the port opening sleeve 820 and the primary port closing sleeve 822 are installed to slide on the outer surface 816 of the wall 811 of a tubular housing. The port opening sleeve 820 slides downwards when actuated using hydraulics, to open ports 818 thus enabling cementing. The primary port closing sleeve 822 is connected to an internal member 842 through a crosslink 844 and slides downwards to close the ports 818 when cementing is completed. Secondary closing sleeve 824 is installed to move along the wall 811 of the tubular housing, above the internal member 842. The secondary closing sleeve 824 is moved in the port covering position when the primary port closing sleeve 822 failed to close the ports 818, or if desired as a back-up closure for the ports 818. The internal member 842 is drilled out to move the secondary closing sleeve 824 to the port covering position. This sleeve may, in this embodiment, move between its port uncovered and port covering positions along a pathway that is unaffected by failures in or debris blockages around the primary port closing sleeve 822, as it is positioned at or between its own port uncovered and port covering positions.

FIG. 8A shows an embodiment of the primary port closing sleeve 922 for an arrangement similar to one in FIG. 7. Namely, as in FIG. 7, the port opening sleeve 920 is installed on the outer surface of the tubular body of the stage tool 900 and opens the port 918 by sliding downwards when actuated using hydraulics. The primary port closing sleeve 922 is installed on the outer surface of the wall 911, above the port opening sleeve 920 and is placed during cementing operation in a port uncovering position, when the cement is allowed to flow from the inner bore 914 of the tool to the wellbore annulus for cementing the annulus through the port 918. As shown in FIG. 8A, the primary port closing sleeve 922 can be moved downwards to a port closing position, where it stops the cement flow through the ports 918. The movement is achieved as in the embodiment of FIG. 2, using internal member 942 attached to the primary closing sleeve 922 through the wall of the tool by a crosslink 944. The secondary closing sleeve 924, used for backup when the primary port closing sleeve 922 fails to close the port 918, is installed on the inner surface of the tool and moves downwards to close the port 918. As illustrated in more detail in FIG. 8B, a collapsible ring 980 contacts the crosslink 944. As it moves down by the pressure exerted by the plug (dart, ball), the ring will contact the undercut shoulder 952 and collapse down releasing the crosslink 944. The primary sleeve will continue the downward movement past the ports 918.

The lower end of internal member 942 can include milling teeth 954. Internal member 942 may continue to travel down until it contacts a no-go feature. According to one embodiment, the no-go feature may comprise a milling castle 956 that engages the milling teeth 954. As will be appreciated by one of ordinary skill in the art, the engagement of the milling teeth to the milling castle can allow the internal member 942 to be more easily milled out. With internal member 942 milled out, the secondary closing sleeve 924, can be shifted down to its port covering position.

FIG. 9 illustrates another embodiment, where initially the primary port closing sleeve 1122 is above the port opening sleeve 1120, both moving on the outer wall of the tubular section. In this embodiment, the primary port closing sleeve 1122 is made of two pieces 1122*a* and 1122*b* with a c-ring. The internal member 1142 moves on the inner wall of tubular section, together with the primary port closing sleeve 1122 as they are connected through crosslink 1144. The installation site of the internal member 1142 with the plug seat 1143 is selected to keep the internal member above the port 1118. The installation site for the secondary closing sleeve 1124 is selected to have the secondary closing sleeve below the port 1118. In operation, the port opening sleeve 1120 is moved in the port opening position to perform cementing. When a plug is conveyed down the string and lands on the seat 1143 provided on the internal member 1142, the primary, external sleeve 1122 moves downwards to close the port 1118. If the port is not closed properly, the seat on the internal member is milled out and the secondary closing sleeve 1124 is moved upwards to close the port.

Figure 10:
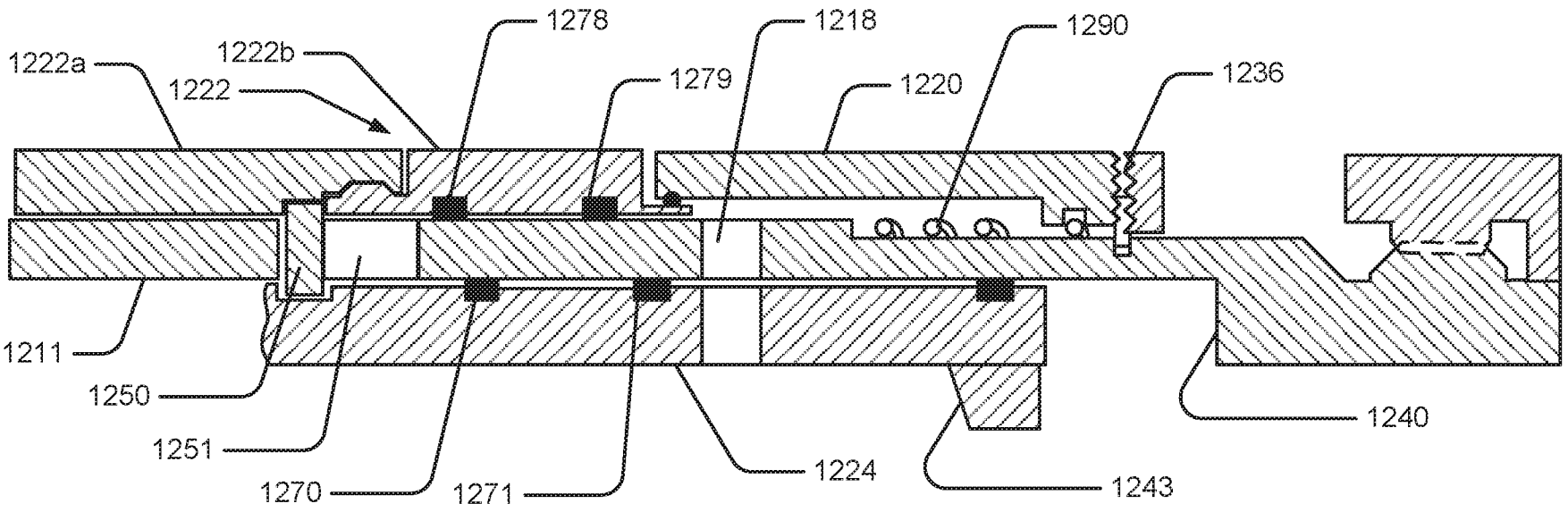
FIG. 10 is a diagrammatic representation of yet another embodiment of a stage tool.
Figure 11:
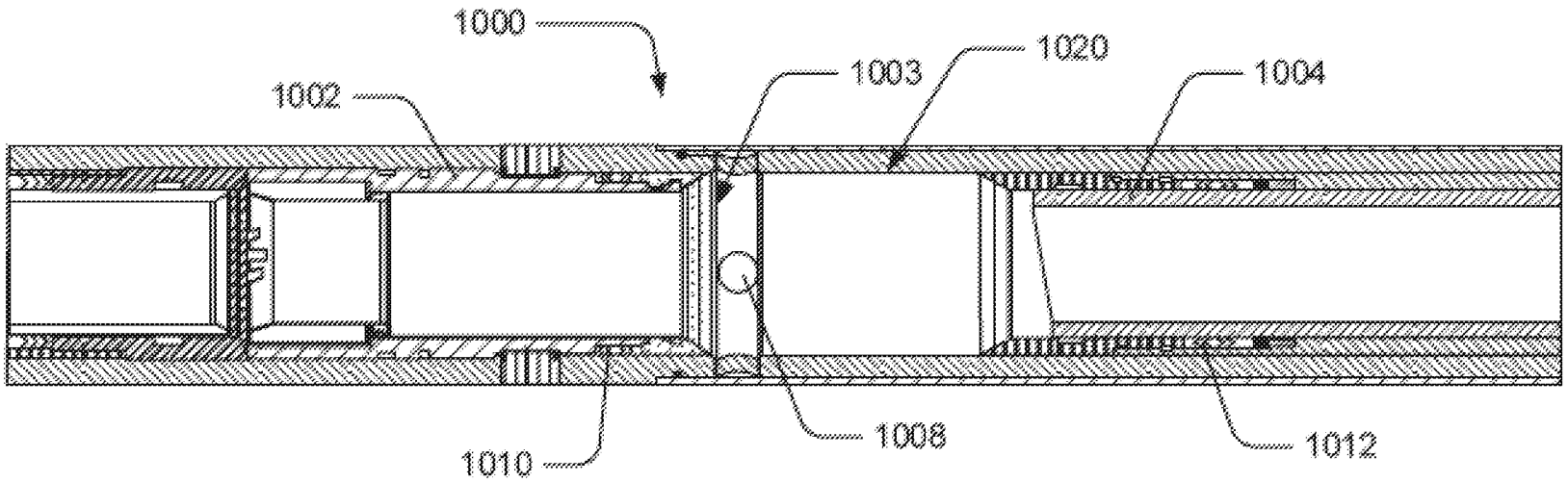
Fig. 11 (PRIOR ART)
FIG. 11 is a diagrammatic representation of an example of a conventional stage tool.

FIG. 10 shows still another embodiment of the stage tool where the primary closing sleeve 1222 is comprised of two pieces 1222*a* and 1222*b*, connected as shown. The primary closing sleeve 1222 moves along the outer wall 1211 of the tubular section 1204, while the secondary closing sleeve 1224 moves along the inner wall 1211 of the tubular section. The primary closing sleeve 1222 and the secondary closing sleeve 1224 are connected with a connecting member 1250, which may be pin or a key. A slot 1251 in the wall 1211 determines the range of motion of the assembly of the two sleeves. Other locking mechanisms may be provided to fulfil this function. Bonded seals 1278 and 1279 are positioned to straddle the port when closed by the sleeve 1222. Similarly, seals 1270 and 1271, are arranged to straddle the port when the secondary closing sleeve 1224 closes the port. In this embodiment, the secondary closing sleeve 1224 comprises a plug seat 1243, adapted to receive a plug that will move the sleeves 1222 and 1224 downward form the respective port open position to the port closed position. Shoulder 1240 stops the assembly of sleeves to move farther down.

Port opening sleeve 1220 is installed to close the port 1218. A releasable setting device 1236 keeps the port opening sleeve against inadvertent movement out of the port closing position, until the holding force of the releasable setting device is controllably overcome The device 1236 may be a shear pin, as shown. Spring 1290 is used to displace sleeve 1220 from the port closing position.

Examples

In one embodiment, an example technical operations procedure is suggested. This is provided to assist with understanding, but not to be considered restrictive of the invention. The suggested example is as follows:

Pre-Job Planning

During the planning stages, the hydrostatic forces should be calculated to determine the shear value for the fluid treatment ports. The difference between the cement density and the density of the displacement fluid should be considered at the proposed depths of the stage tool.

Wellbore hydraulics should be considered to ensure that the differential pressure will not cause a "light pipe" condition due to string buoyancy.

Shear pin timing should be considered in the program design. The stage tool should be set to shear higher than the any string packers to be set by hydraulics, and lower than the any opening mechanism for wellbore fluid treatment ports, with a reasonable safety factor.

Placement

Pick up and run lower section of liner or casing string.

Pick up and run packers as required for a bass to cement cross if they are planned for the system.

Pick up and install stage tool in casing string at appropriate depth.

Run the system at the desired cementing depth in the casing string. According to one embodiment, the stage tool can be run in the tool string to a depth to give a minimum of 1 (6.5 bbl) and possibly 2 m3 (13 bbl) of annular volume to the planned bottom of the cemented zone, when possible, to allow for adequate flushing.

According to one embodiment, the tool can be run directly above an open hole packer possibly also including slips for both zonal isolation in the annulus below the cementing ports and for positional locking in the wellbore.

Run in hole (RIH) speeds may be limited by the packers.

The stage tool is locked in a closed position until activated hydraulically or by opening plug.

Once the liner is at depth, full circulation of the well (through a float shoe at the toe of the string) can be established.

Once the fluid is balanced, up/down string weights should be determined.

At this point the packers can be set, for example if hydraulically set by pressuring up the string, and pressure tested following the procedure for these tools.

Tool Function: Cementing

Pump the first stage of cement either through the toe of the well or through the lower stage tool. According to one embodiment, it should be ensured that there is cement retarder in case cement is circulated across the upper stage tool.

Gravity drop the weighted opening plug and pressure up (e.g., in one embodiment to approximately 1000 to 1500 psi) to shift stage tool to open position/increase pressure to hydraulically open stage tool.

Establish a cement circulating rate at desired rate. For example, establish cement circulating rate at approximately 5 barrels per minute.

Circulate to condition the upper section of the well as needed for project.

Pump cement spacer followed by cement slurry.

Tool Function: Closing the Ports

Launch closing plug.

Once plug has left surface, begin displacing with water or appropriate displacement fluid.

Displace at desired rate, preferably similar to cementing rate. For example, displace approximately 5 barrels per minute or similar to cementing pump rate until 10 barrels from landing plug.

Slow pump rate to desired rate, say two barrels per minute.

Land plug and pressure up to shift closing sleeve. According to one embodiment closing pressure should be approximately 1500 PSI above cement hydrostatic lift pressure.

Hold for specified period of time (e.g., approximately 5 minutes or other period).

Slowly bleed off to ensure primary closing sleeve holds

If primary holding sleeve does not hold, close using secondary closing sleeve.

Once pressure is bleed off, monitor for specified period of time (e.g., approximately 30 minutes or other period).

Close stabbing valve and break off cementing head.

Monitor casing pressure as per project specifications.

U.S. Pat. No. 9,121,255, hereby fully incorporated as part of this disclosure, provides additional context and disclosure regarding stage tools and cementing.

Although the invention has been described with respect to specific embodiments thereof, these embodiments are merely illustrative, and not restrictive of the invention. Rather, the description is intended to describe illustrative embodiments, features and functions in order to provide a person of ordinary skill in the art context to understand the invention without limiting the invention to any particularly described embodiment, feature, or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, product, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein, the meaning of "in" includes "in" and "on" unless the context clearly dictates otherwise.

What is claimed is:

1. A stage tool for stage treatment of a lined wellbore, comprising:

a body with a longitudinal inner bore enclosed by a tubular wall with an outer surface, an inner surface and a fluid port;

a primary closing sleeve, moveable on the outer surface from a port open position to a port closed position to seal the fluid port on the outer surface;

a secondary closing sleeve, movable on the inner surface of the body from a port uncovered position to a port covering position to seal the fluid port on the inner surface, the secondary closing sleeve having attaching means adapted to be engaged by a shifting tool so as to move the secondary closing sleeve on the inner surface of the tubular wall from the port uncovered position to the port covering position; and a port opening sleeve, axially moveable on the inner surface of the tubular wall downwards from a port closing position to a port opening position, wherein the primary and secondary closing sleeves are movable independently of each other, along the outer surface and the inner surface respectively, to redundantly seal the fluid port.

2. The stage tool of claim 1, further comprising an internal member joined to the primary closing sleeve and movable on the inner surface.

3. The stage tool of claim 2, wherein the internal member and the primary closing sleeve are joined by a crosslink.

4. The stage tool of claim 3, wherein the tubular wall is provided with a longitudinal channel, shaped to enable travel of the crosslink when the primary closing sleeve moves from the port open position to the port closed position.

5. The stage tool of claim 2, wherein the internal member and the secondary closing sleeve move along different surfaces on the internal wall, to avoid interference.

6. The stage tool of claim 2, wherein the internal member includes a plug seat adapted to capture a plug conveyed down the lined wellbore for sealing the longitudinal inner bore.

7. The stage tool of claim 1, wherein the primary closing sleeve is adapted to move downwards on the outer surface of the tubular wall from the port open position to the port closed position.

8. The stage tool of claim 1, further comprising:

a first releasable setting device having a first holding force which keeps the primary closing sleeve against inadvertent movement out of the port closed position until the first holding force of the first releasable setting device is controllably overcome; and a second releasable setting device having a second holding force which keeps the primary closing sleeve against inadvertent movement out of the port open position, until the second holding force of the second releasable setting device is controllably overcome.

9. The stage tool of claim 1, further comprising a first and a second locking mechanism adapted to maintain the primary closing sleeve in the port closed and the port open position respectively.

10. The stage tool of claim 1, further comprising a stopping point to controllably stop movement of the primary closing sleeve when the primary closing sleeve attains the port closed position.

11. The stage tool of claim 1, wherein the secondary closing sleeve is adapted to move downwards on the inner surface of the tubular wall from the port uncovered position to the port covering position.

12. The stage tool of claim 1, wherein the secondary closing sleeve comprises at least two seals arranged to straddle the fluid port when the secondary closing sleeve is in the port closed position.

13. The stage tool of claim 1, further comprising:

a third releasable setting device having a third holding force which keeps the secondary closing sleeve against inadvertent movement out of the port covering position until the third holding force of the third releasable setting device is controllably overcome; and a fourth releasable setting device having a fourth holding force which keeps the secondary closing sleeve against inadvertent movement out of the port uncovered position, until the fourth holding force of the fourth releasable setting device is controllably overcome.

14. The stage tool of claim 1, the port opening sleeve further comprising one or more seals arranged to deter fluid leakage between the port opening sleeve and the tubular wall.

15. The stage tool of claim 1, further comprising a releasable setting device having a holding force which keeps the port opening sleeve against inadvertent movement out of the port closing position, until the holding force of the releasable setting device is controllably overcome.

16. The stage tool of claim 1, wherein the secondary closing sleeve is adapted to move upwards on the inner surface of the tubular wall from the port uncovered position to the port covering position.

17. A method for stage treatment of a wellbore, comprising:

running a stage tool into the wellbore, the stage tool having a body defined by a tubular wall provided with a fluid port, the stage tool comprising an inner bore, a port opening sleeve, a primary closing sleeve movable on an outer surface of the tubular wall to cover the fluid port after stage treatment, and a secondary closing sleeve movable on an inner surface of the tubular wall;

controllably actuating the port opening sleeve of the stage tool to open the fluid port;

when stage treatment is completed, controllably actuating the primary closing sleeve to slide on the outer surface of the tubular wall to seal the fluid port on the outer surface; and controllably actuating a secondary closing sleeve with a shifting tool to slide on the inner surface of the tubular wall from a port uncovered position to a port covering position to seal the fluid port on the inner surface, wherein the secondary closing sleeve slides independently of the primary closing sleeve to redundantly seal the fluid port.

18. The method of claim 17, wherein controllably actuating the port opening sleeve comprises:

sealing the inner bore by launching an opening plug in the inner bore to land on a plug seat installed on the port opening sleeve; and applying hydraulic pressure though the inner bore to move the port opening sleeve from the port closing position to a port opening position.

19. The method of claim 17, wherein controllably actuating the primary closing sleeve comprises:

sealing the inner bore by launching a closing plug through the inner bore to land on a plug seat provided on an internal member of the primary closing sleeve; and applying hydraulic pressure though the inner bore to move the internal member together with the primary closing sleeve downwards from the port open position to the port closed position.

20. The method of claim 17, wherein controllably actuating the primary closing sleeve comprises:

applying pressure on an internal member provided in the inner bore, the internal member being linked with the primary closing sleeve over a crosslink through the tubular wall; and the internal member driving the primary closing sleeve to slide on the outer side of the tubular wall from a port open position to a port closed position, wherein in the port closed position, seals provided on the primary closing sleeve deter fluid leakage through the fluid port.

21. The method of claim 20, wherein applying pressure on the internal member comprises:

launching a plug to be captured on a seat provided on the internal member; and applying hydraulic pressure from surface to create a pressure differential across the plug seated on the seat of the internal member to displace the internal member and the primary closing sleeve into the port covering position.

* * * * *